United States Patent [19]

Gudmestad et al.

[11] 4,375,186

[45] Mar. 1, 1983

[54] AUTOMATIC CORD HANKING MACHINE

[75] Inventors: Ragnar Gudmestad, West Allis; John D. Butler, New Berlin, both of Wis.

[73] Assignee: Artos Engineering Company, New Berlin, Wis.

[21] Appl. No.: 277,964

[22] Filed: Jun. 26, 1981

[51] Int. Cl.[3] ..... B65B 13/28

[52] U.S. Cl. ..... 100/7; 28/291; 53/113; 100/31

[58] Field of Search ..... 100/2, 7, 31; 242/53; 28/291; 29/863; 53/113

[56] References Cited

U.S. PATENT DOCUMENTS

| | | | |
|---|---|---|---|
| 2,654,980 | 10/1953 | Dexter | 53/113 |
| 2,770,183 | 11/1956 | Hanscom | 100/31 X |
| 3,480,219 | 11/1969 | Hanscom | 242/53 |
| 3,480,220 | 11/1969 | Hanscom | 242/53 |
| 3,909,900 | 10/1975 | Gudmestad | 29/863 X |

*Primary Examiner*—Billy J. Wilhite

*Attorney, Agent, or Firm*—James E. Nilles

[57] ABSTRACT

This cord hanking machine has two turntables coaxially mounted on a carrier, each having pair of coiling posts spaced to opposite sides of its axis and projecting away from the other turntable. The carrier swings about an axis transverse to the coinciding axes of the turntables to carry each turntable alternately to a coiling station and to a tying station. Gripper jaws at the outer end of each post open to clamp a straight stretch of cord presented to the turntable at the coiling station. As that turntable rotates, an oscillating cord guide adjacent to the coiling station guides the cord into a coil around its posts. At the tying station a tying machine moves bodily toward the turntable and places a wire tie around the coiled cord on it. During tying, a claw on the tying machine engages behind the coil, and as the tying machine retracts from the turntable the hank is thereby drawn off of its posts.

21 Claims, 32 Drawing Figures

AUTOMATIC CORD HANKING MACHINE

FIELD OF THE INVENTION

This invention relates to hanking machines whereby lengths of wire, rope or other cord are coiled and tied to form them into uniform hanks; and the invention is more particularly concerned with a hanking machine than can operate fully automatically, without the need for manually feeding cords to it.

BACKGROUND OF THE INVENTION

A commercially available cord hanking machine that is rather widely used is disclosed in U.S. Pat. Nos. 3,480,219 and 3,480,220, both issued to H. F. Hanscom. The machine of those patents comprises a turntable that is rotatable on a vertical axis and has a pair of upright posts spaced to opposite sides of its axis. An operator manually inserts one end portion of a cord into a clip on the turntable and depresses a foot switch to start the turntable rotating. As the turntable rotates, the cord is wound around its posts. The turntable stops after it has made a predetermined number of turns, whereupon an arm on another part of the machine moves down and removes the coiled cord from the turntable posts. Removal of the coil is effected by claws on the arm which engage the coil at spaced apart locations between the posts and close around it. The arm moves straight up to lift the coil off of the posts and then swings laterally to carry the coil to a tying machine by which a wire tie is looped around the middle of the coil and twisted upon itself. The claws thereafter open to release the tied hank onto a receptacle or a conveyor.

Once the coil has been lifted away from the posts, the operator can attach a new cord to the turntable to start a new winding cycle. Winding of one cord can thus take place during the time that a previously wound coil is being tied and released from the arm.

It is apparent that the machine of the Hanscom patent can achieve high production with a diligent and patient operator. However, it is also apparent that feeding cords to such a machine demands a certain amount of concentration and coordination on the part of the operator but is a very monotonous task and is therefore very fatiguing.

So far as is known, every cord hanking machine heretofore devised has required the constant presence of an operator who had to feed each cord to the machine and thus, in effect, perform one or more of the functions in the cord hanking cycle.

This need for an operator entailed further problems and expenses with respect to labor and materials handling. Cords to be hanked are usually subject to prior processing that may involve cutting cord stock into individual cord lengths, being and twisting the ends of wires comprising the cord, and attaching plugs and/or terminal connectors to the bared end portions of the wires. Such processing is usually done on an automatic machine from which the cords are ejected one by one. When hanking requires manual feed to the hanking machine, cords issuing from the processing machine must be collected in batches and must be arranged in an orderly manner so that they can be readily picked up one by one by the hanking machine operator. Each batch of cords must of course be transported to the hanking station.

It is apparent that a substantial amount of unproductive handling of cords can be eliminated by eliminating the manual feeding of cords to the hanking machine. However, in view of the very evident desirability of a fully automatic cord hanking machine, it is apparent that complete automation of the hanking process has heretofore been unobtainable with the exercise of mere skill in the art.

For high speed production and efficient utilization of each of the coiling, tying and ejection mechanisms of a hanking machine, two or more operations—such as coiling and tying—should always be taking place simultaneously during normal operation of the machine. One of the problems involved in the provision of a fully automatic hanking machine is that the mechanisms for performing its various operations must be so coordinated and arranged that efficient performance of simultaneous operations can take place without interference between the mechanisms that perform such operations.

Another and particularly troublesome problem presented by the provision of an automatic hanking machine is that of initially connecting a cord with the coiling mechanism of the machine so that the cord can be wound into a coil. Manual insertion of a cord into a clip, although easily enough accomplished, nevertheless involves a complex of motions that cannot be readily produced by mechanical means. As a further complication, the attachment of the cord to the coiling mechanism must be of such character that the coiled cord can be removed by a simple automatically operating mechanism.

SUMMARY OF THE INVENTION

The general object of this invention is to eliminate from the operations relating to the hanking of cords and cord sets a substantial amount of labor that is not really productive and is monotonous and fatiguing; and more specifically it is an object of this invention to provide a fully automatic cord hanking machine which can receive cords one by one directly from a processing machine and form each cord into a tied hank immediately after it comes off of the processing machine.

Another object of this invention is to provide an automatic cord hanking machine having feeding mechanism whereby a cord to be hanked is brought to a straight extended condition and having a coiling mechanism which is so arranged as to be capable of receiving and coiling a cord that is presented to it in such condition, said coiling mechanism having grippers which close upon spaced apart portions of the straight cord and which are arranged to be normally in a closed clamping condition but are cooperable with a simple actuator whereby they are opened for release of a cord at the conclusion of a hanking operation and for reception of a new cord to begin a new operating cycle.

Another object of this invention is to provide an automatic cord hanking machine having two cord coiling turntables that are supported on a turntable carrier whereby each turntable is alternately moved to a coiling station at which it receives a cord and winds the cord into a coil and to a tying station at which a wire tie is placed around the coil and the hanked cord is stripped off of the turntable, said turntable carrier being arranged to dispose one of the turntables at the coiling station while the other is at the tying station to provide for simultaneous performance of the respective coiling and tying operations.

A further object of the invention is to provide an automatic cord hanking machine having coiling and tying stations, as just described, wherein a tying machine is bodily movable towards and from an operative position at the tying station, and wherein movement of the tying machine away from the tying station locates it clear of coiling turntables being moved into and out of that station and also enables the tying machine itself to perform the function of removing hanked and tied cords from turntables at the tying station.

It is a further specific object of this invention to provide an automatic cord hanking machine having two coiling turntables carried by a turntable carrier that is swingable through 180° in opposite directions to carry each turntable between a coiling station and a tying station, said machine having a turntable drive mechanism for causing the turntable at the coiling station to undergo a predetermined number of coiling rotations and being so arranged that, at all times when coiling is not actually occurring, both turntables are locked in predetermined positions of their rotation that enable a cord to be presented to the turntable at the coiling station and enable the tying machine to cooperate with the turntable at the tying station.

It is also a specific object of this invention to provide an automatic cord hanking machine having a cord coiling turntable with a pair of cord coiling posts that project forwardly from the front face of the turntable at opposite sides of its rotational axis, said posts being normally in coiling positions at equal but readily adjustable distances from said axis but being bodily movable towards said axis against yielding bias, to relieve tension on a hanked cord embracing them, so that the hank can be readily stripped forwardly off of them.

BRIEF DESCRIPTION OF DRAWINGS

In the accompanying drawings, which depict what is now regarded as a preferred embodiment of the invention.

DETAILED DESCRIPTION OF PREFERRED EMBODIMENT OF THE INVENTION

General Arrangement of the Machine

Figure 1A:
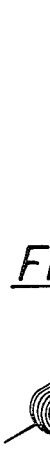
FIG. 1*a* is a perspective view of a cord that has been coiled on the machine but not yet tied, shown as it would appear apart from the coiling turntable.
Figure 1B:
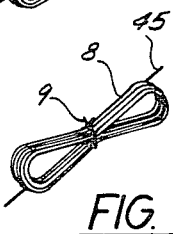
FIG. 1*b* is a perspective view of a tied and completed hanked cord produced by the machine.
Figure 1:
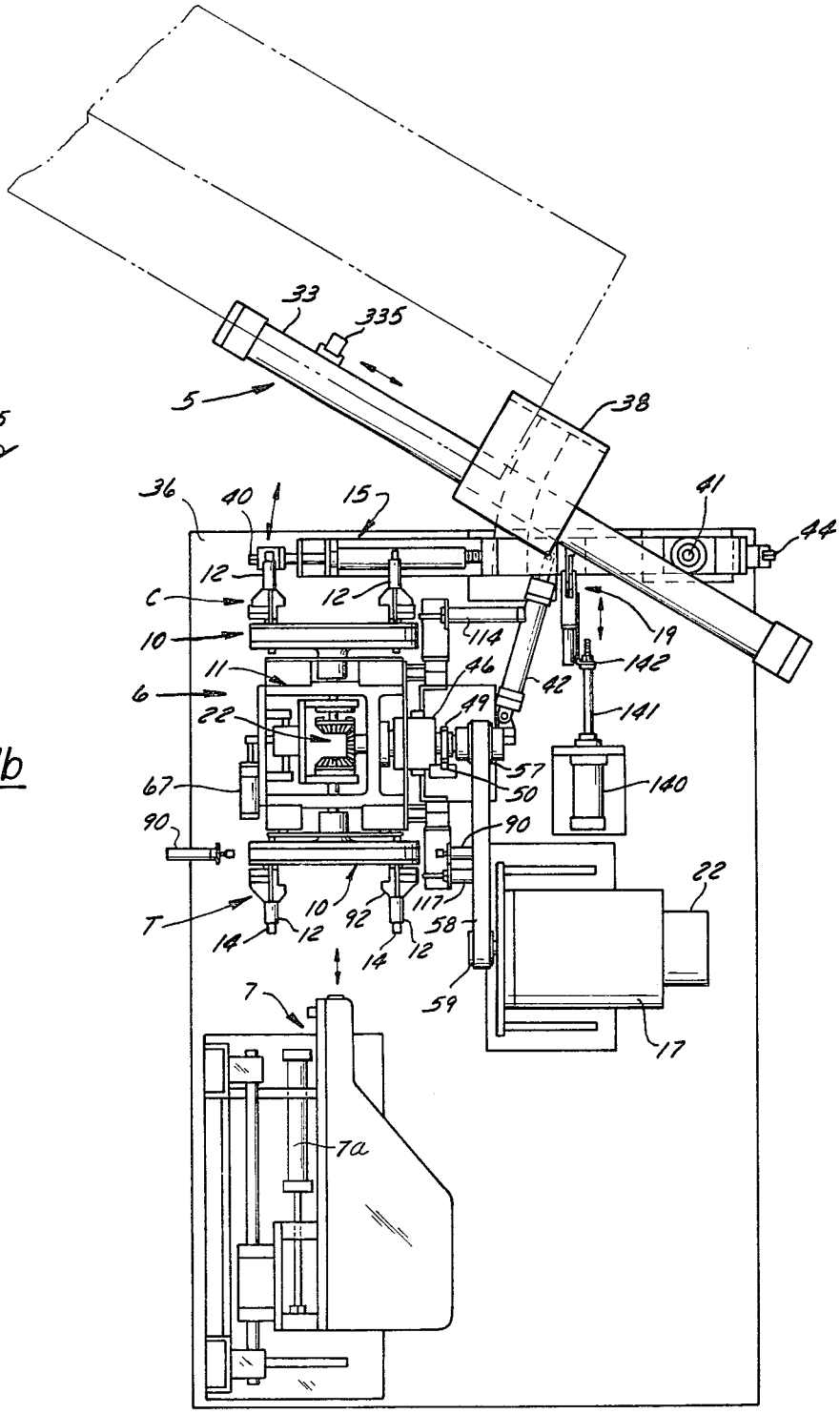
FIG. 1 is a plan view of the complete machine of this invention in the condition in which the cord feeding mechanism is presenting a cord to the turntable at the coiling station.

Referring first to FIG. 1 of the accompanying drawings, a cord hanking machine embodying the principles of this invention comprises three main subassemblies, namely a feeding device 5, a coiling mechanism 6 to which cords are successively presented by the feeding device 5 and by which each cord is wound into a coil, and a tying machine 7 by which a wire tie is looped around a coiled cord and is twisted upon itself to hold the cord tied into a hank. FIG. 1*a* shows the appearance of a cord 8 as coiled by the coiling mechanism 6, and FIG. 1*b* shows the appearance of the finished hank with a wire tie 9 looped around the middle of the coiled cord and twisted upon itself.

The coiling mechanism 6 comprises two essentially identical turntables 10 that are mounted in coaxial, spaced apart relation to one another upon a yoke-like turntable carrier 11. Each turntable 10 has a pair of coiling posts 12 that project from it in the direction away from the other turntable, said posts 12 being parallel to the turntable axis and spaced to opposite sides thereof. As explained hereinafter, the posts 12 are normally in coiling positions at equal but adjustable distances from the turntable axis, but each post is bodily movable relative to its turntable, against yielding bias, through a limited distance towards the axis of its turntable. The turntable carrier 11 rotates through 180° in each direction about an axis transverse to the coinciding rotational axes of the turntables 10, to carry each turntable alternately to a coiling station C in which it is near the feeding device 5 and to a tying station T in which it is near the tying machine 7. When one of the turntables is at the coiling station C, the other is of course at the tying station T. At each station the coiling posts 12 extend horizontally.

Each coiling post 12 of each turntable 10 has at its outer or forward end a pair of jaw-like cord grippers 14.

At the start of an operating cycle a turntable 10 is at its coiling station C, in a position of rotation in which both of its posts 12 have their axes contained in a single horizontal plane, and the grippers 14 on the outer ends of the posts are in their open or diverged positions, with the jaws of each gripper spaced apart vertically. A cord 8 to be hanked is presented to the grippers 14 by a delivery arm 15 of the feeding device 5, as explained hereinafter. The portion of the cord that is presented to the grippers 14 extends horizontally and is disposed between the jaws of the grippers, with one of its ends near one of the posts 12.

Figure 2:
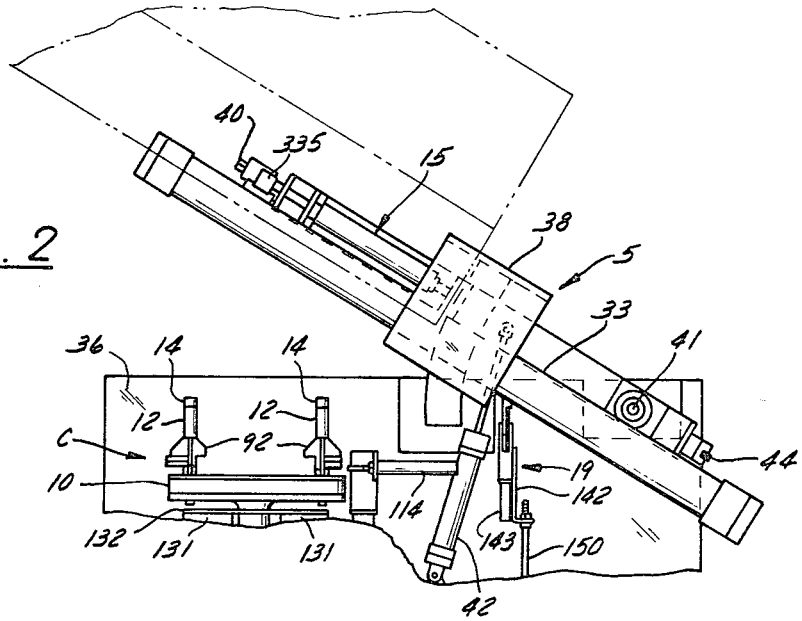
FIG. 2 is a plan view of the portion of the machine comprising the cord feeding mechanism, which mechanism is shown in its condition for picking up a cord.
Figure 5:
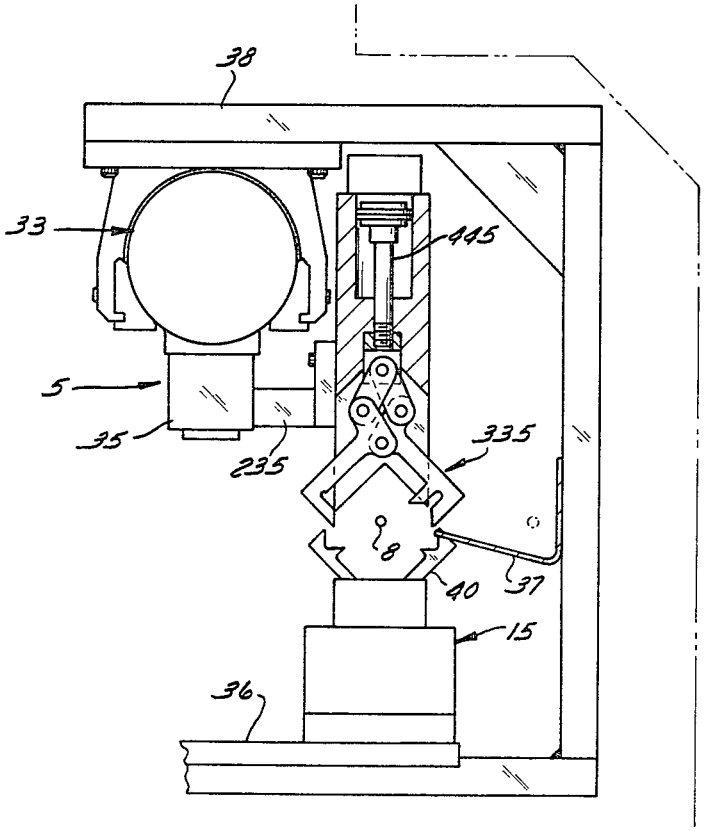
FIG. 5 is a view in section, taken on the plane on the line 5—5 in FIG. 4.
Figure 3:
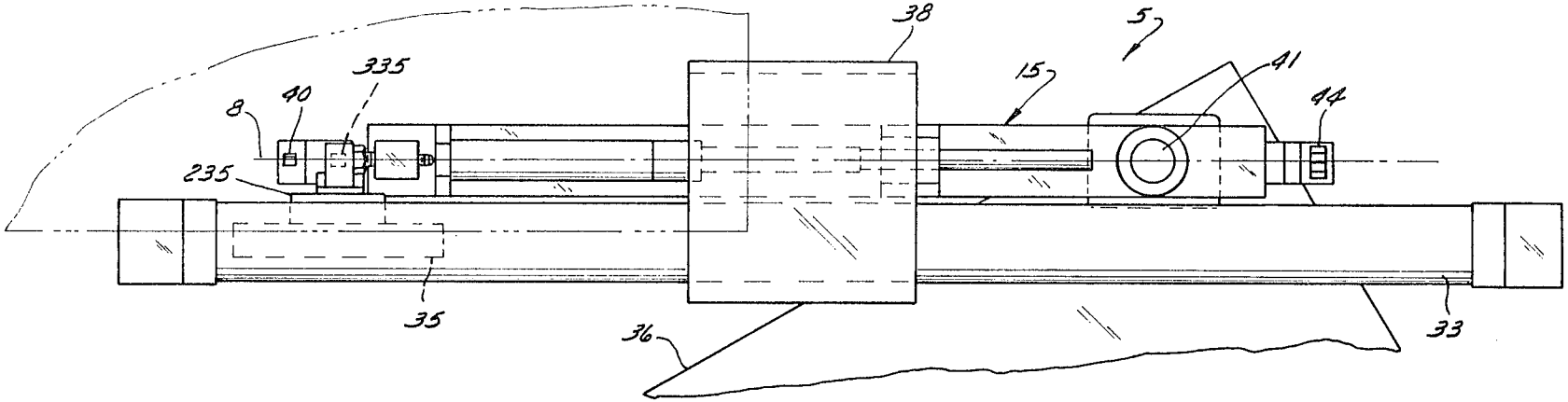
FIG. 3 is a view generally similar to FIG. 2 but on a larger scale.
Figure 24A:
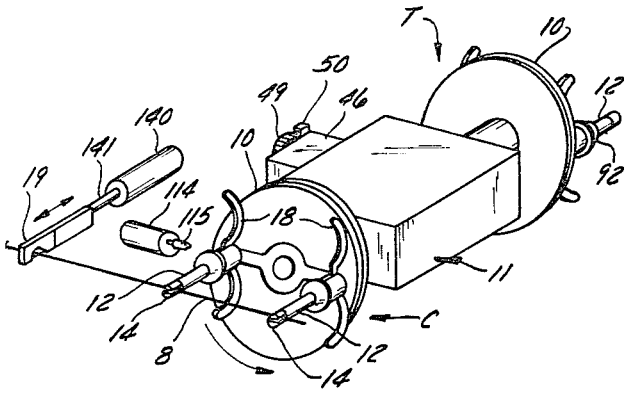
FIGS. 24*a–g* are diagrammatic perspective views showing conditions of the turntables, their coiling posts and grippers and their coil holding claws at various times during the hanking cycle.

The grippers 14 of both posts 12 close on the cord 8 (FIG. 24*a*), whereupon the delivery arm 15 swings outwardly away from the coiling station, to its receiving position shown in FIG. 2, where it is well clear of the turntable 10 at the coiling station C. That turntable then goes into rotation about its axis, causing the cord 8 that is held by its grippers 14 to be coiled about its posts 12.

For guiding and controlling the cord as it is being coiled, the machine has a winding guide 19 (best seen in FIG. 6) which is spaced radially to one side of the turntable at the coiling station. As a cord is presented to the grippers 14 on the winding posts 12, it is also presented to open jaws of the winding guide, which close around the cord to define a guide eye 20 in which the cord is lengthwise slidable and which, during turntable rotation, oscillates in directions parallel to the turntable axis to distribute the cord along the lengths of the posts 12. The winding guide 19 thus functions in the manner of a level-wind mechanism such as is conventionally used in coil winding machines.

The turntable 10 at the coiling station C is driven for its rotation by a stepping motor 17 through a clutch 22, as described hereinafter, and it makes a predetermined number of revolutions, related to the distance between its posts 12 and the length of the cord 8 to be wound.

Figure 24D:
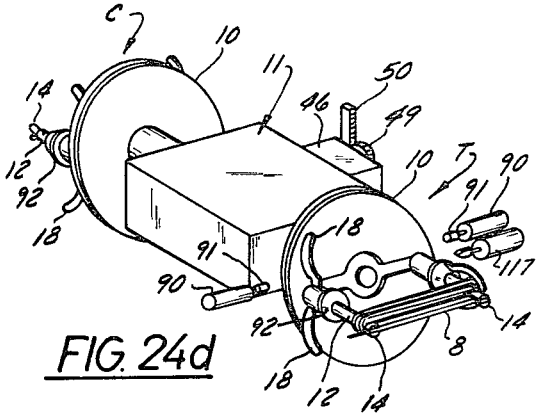
Figure 24B:
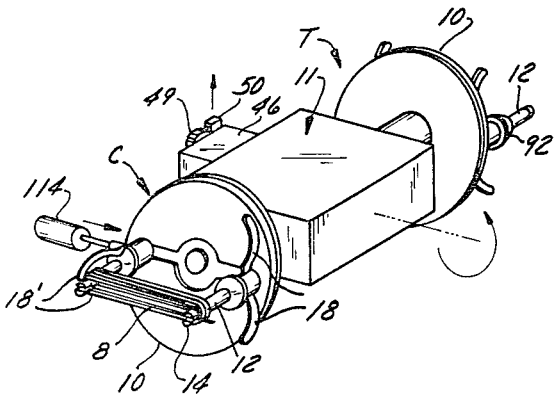
Figure 24E:
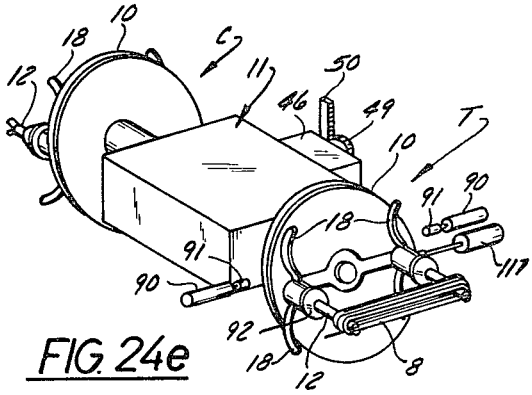
Figure 24C:
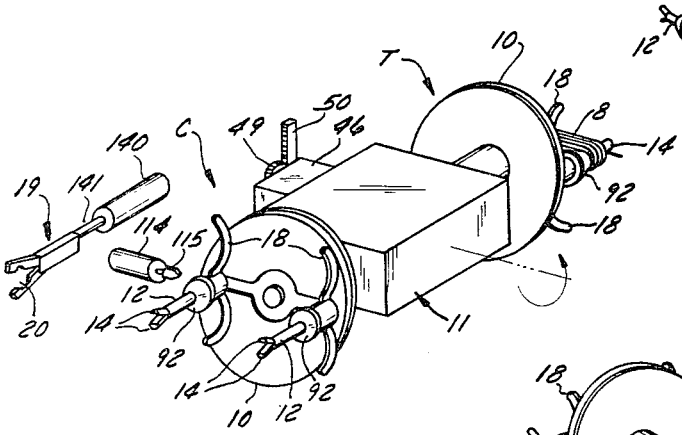

Adjacent to each post 12 on each turntable there is a pair of coil holding claws 18 that maintain an open, widely diverged relationship until the coiling operation is completed. When the turntable stops rotating, one of these pairs of claws 18' (FIG. 24*b*) is converged to embrace the coil of cord around its post 12 and prevent the newly-wound coil from unwinding or being displaced outwardly off of the posts 12. Now the turntable carrier 11 swings around through 180° (FIGS. 24*c* and 24*d*) so that the two turntables 10 change stations. The feeding and coil winding processes begin for the turntable that is newly arrived at the coiling station C, and the newly wound coil carried by the other turntable is now tied at the tying station T.

Before actual tying takes place, the coil holding claws 18' that had been converged at the coiling station are brought back to their diverged open condition (FIG. 24*e*) so that they will not interfere with the tying operation.

Figure 6:
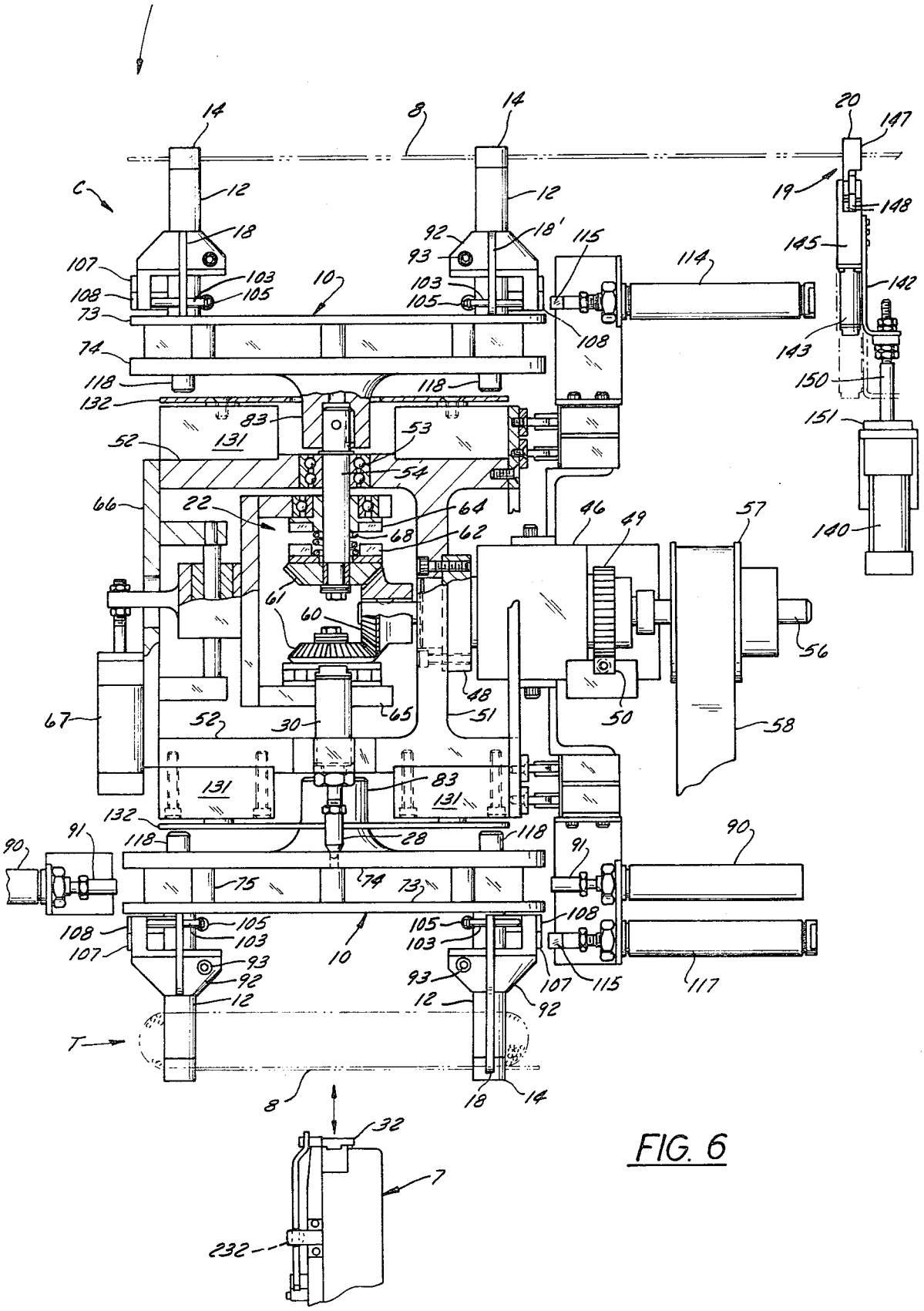
FIG. 6 illustrates the turntable carrier, the turntables and their related mechanisms of the machine, mainly in plan view on a larger scale than FIG. 1 but with portions broken away and shown in section, and with the apparatus in its condition for starting a coiling operation.
Figure 24F:
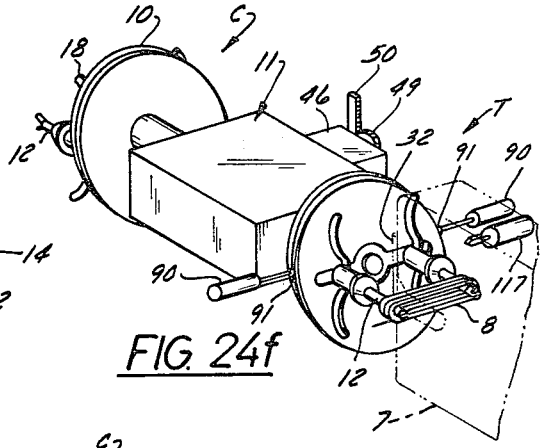

The tying machine 7 that accomplishes tying is generally conventional, but it is mounted for bodily motion, by means such as the pneumatic cylinder 7*a* (FIG. 1), towards and from the turntable carrier 11. When a turntable 10 first comes into the tying station T, the tying machine 7 is in a retracted position, substantially spaced from the turntable carrier 11, as shown in FIGS. 1 and 6. When the coil holding claws 18 have been opened, the tying machine 7 moves bodily to an operating position (FIG. 24*f*) in which its jaws 21 embrace the coiled cord 8 on the turntable, midway between the posts 12, and the machine 7 functions in its conventional manner to loop a wire tie 9 around the coil and twist the ends of the tie to secure it.

Figure 7:
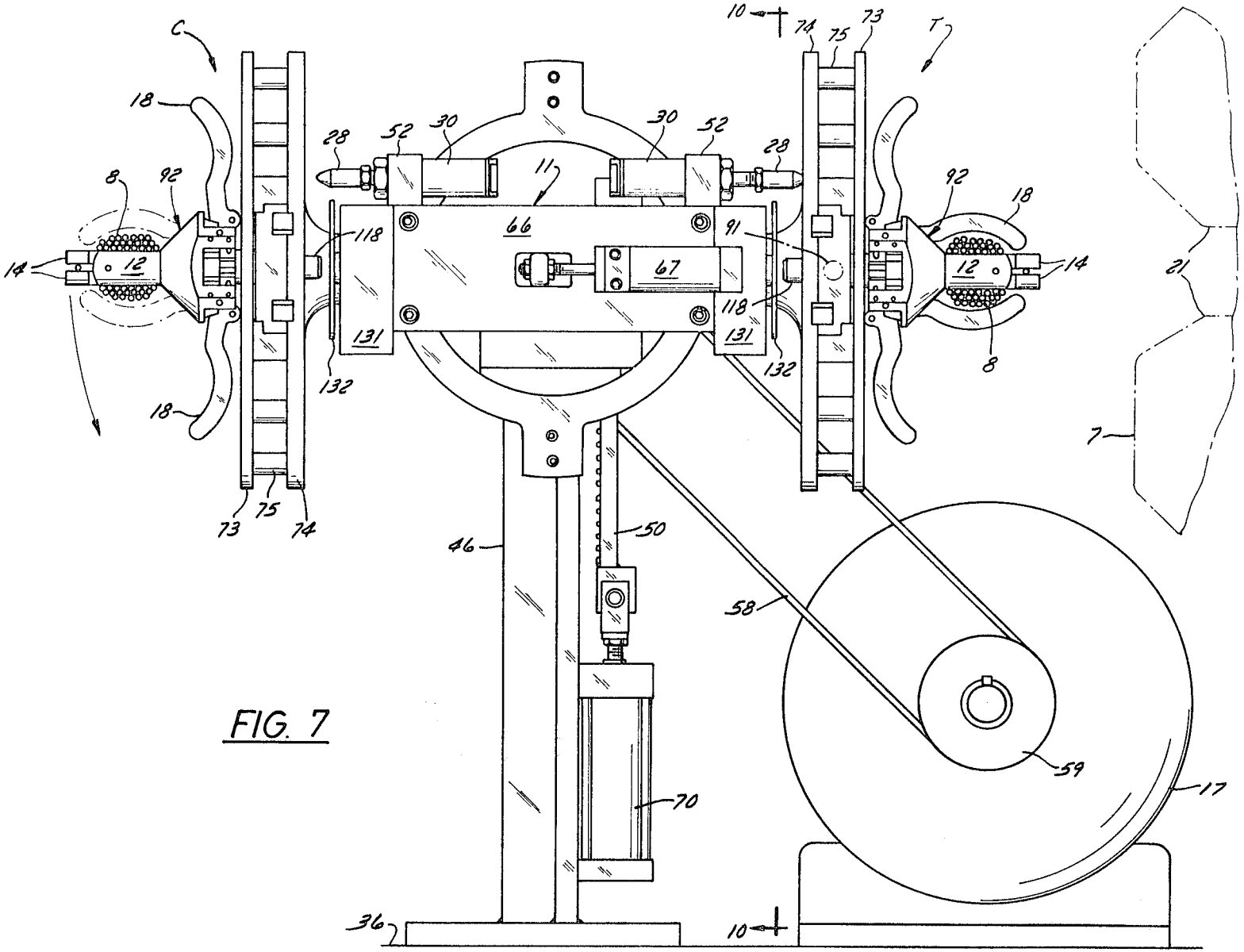
FIG. 7 is a view in elevation, on a larger scale than FIG. 6, showing the turntable at the coiling station in its condition for beginning a coiling rotation and the turntable at the tying station correspondingly in its condition immediately prior to a tying operation.
Figure 12:
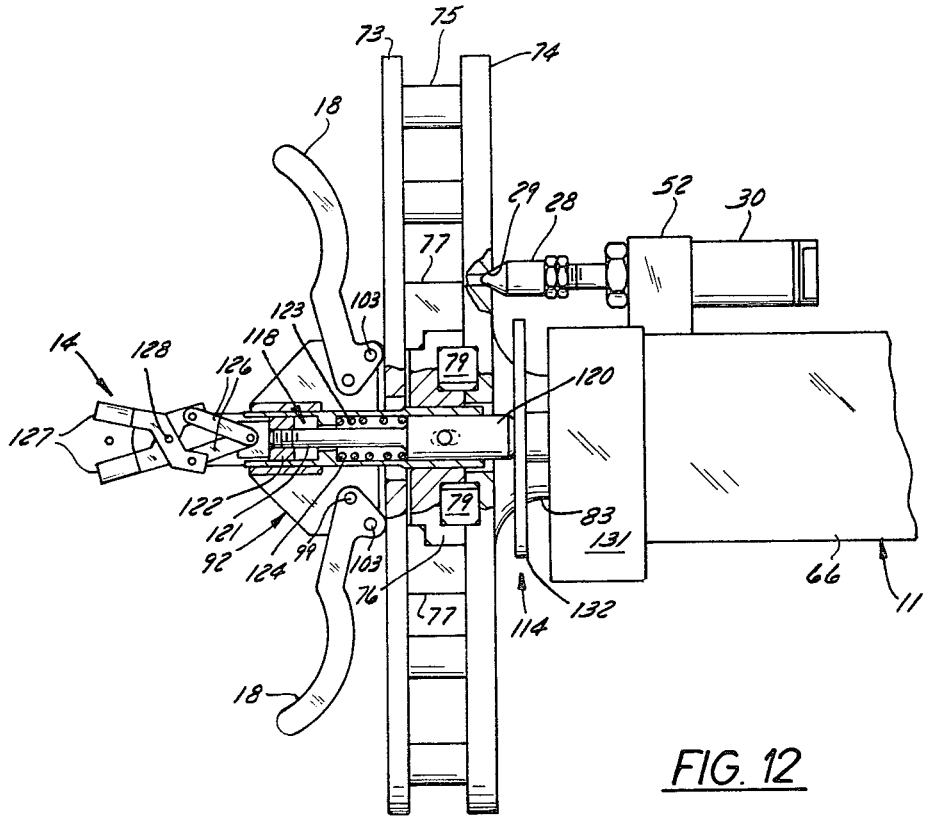
FIG. 12 is a view of one of the turntables, mainly in side elevation but with portions broken away and shown in section substantially on the axis of one of the coiling posts to illustrate the gripper for that post (shown with its jaws open) and the mechanism for actuating that gripper.

For proper orientation of the coil relative to the vertically spaced jaws 21 of the tying machine, the turntable 10 at the tying station T must be in a position of its rotation at which its posts 12 are in horizontal alignment with one another. This is the same rotational position that it must have at the coiling station C for reception of a cord presented to its grippers 14. Immediately upon the conclusion of its winding rotation, and while the turntable 10 at the winding station C is still clutched to the stepping motor 17, a latching rod 28 (FIGS. 7, 8, 12) that is slidable on the turntable carrier 11 is axially projected into a socket or well 29 in that turntable to confine it in the rotational position just mentioned. The latching rod 28 remains in this locking condition through the time that the turntable is at the tying station T and until it has returned to the coiling station C and is ready to start rotation for the winding of a new coil. Hence, there is a latching rod 28 for each turntable. Each latching rod 28 can comprise the piston of a small pneumatic cylinder actuator or the plunger of a solenoid actuator, such actuator 30 being in any case mounted on the turntable carrier 11 behind its turntable, in radially spaced relation to the coinciding axes of the turntables and with the axis of its rod 28 parallel to the turntable axes.

Figure 8:
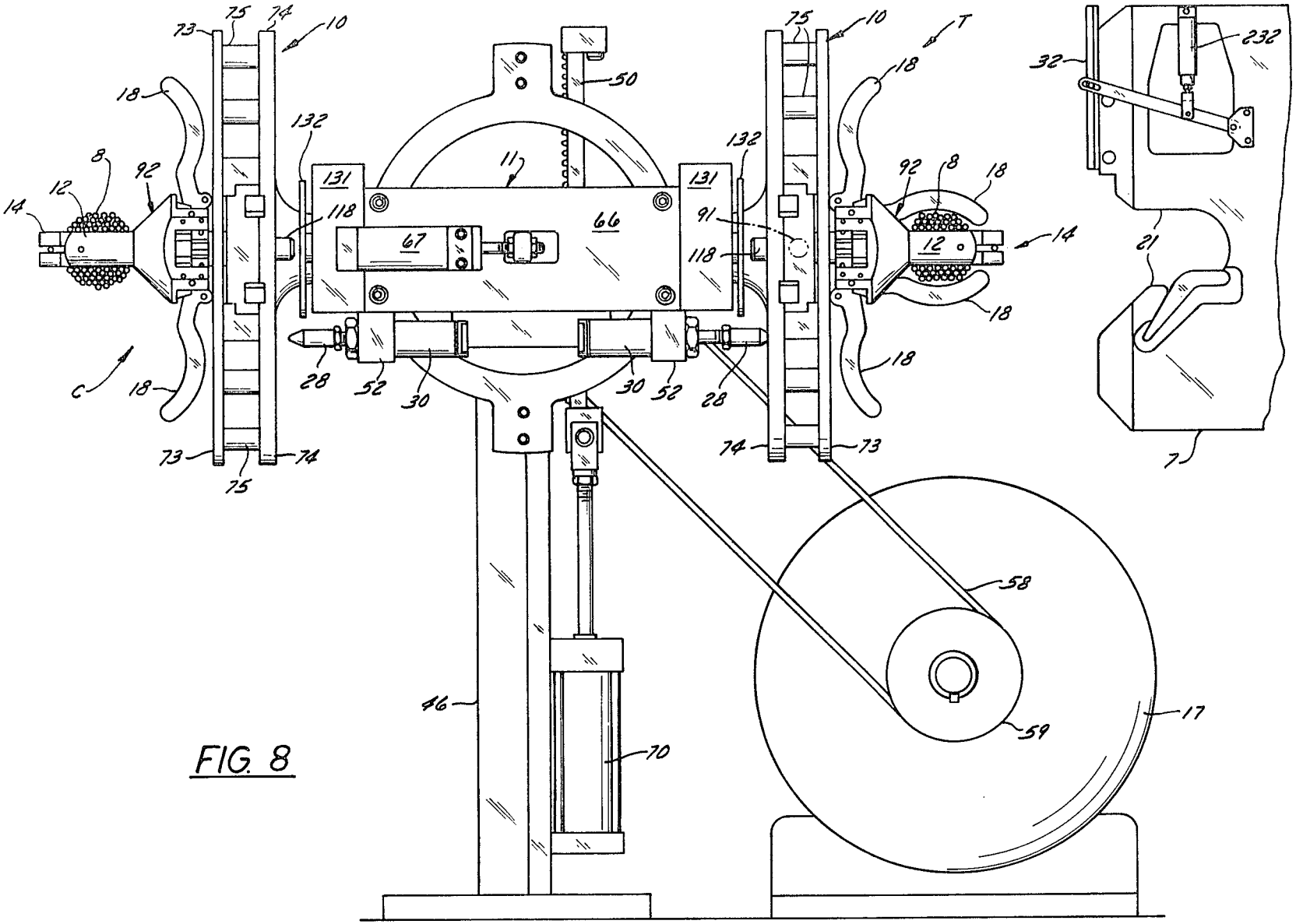
FIG. 8 is a view generally similar to FIG. 7 but showing the turntable carrier swung to its opposite position.
Figure 24G:
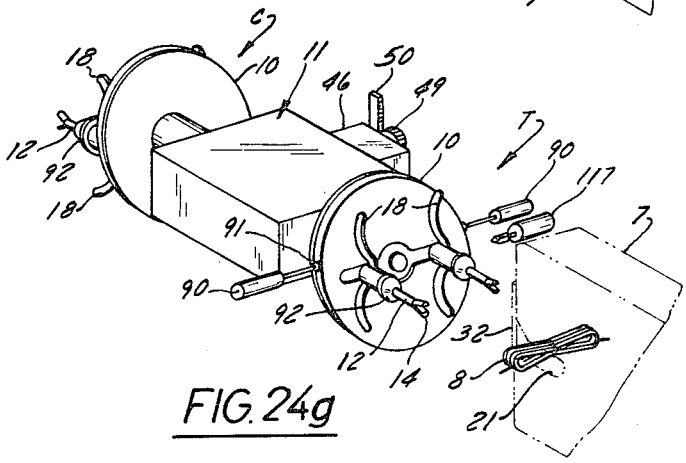

As the tying machine 7 moves to its operative position, the coiling posts 12 on the turntable at the tying station are moved toward one another to some extent, as explained hereinafter, to slacken the cord coil for tying; and the posts 12 are held in that converged relationship as the tying machine moves back to its retracted position, so that the tied coil can be readily slid endwise off of the posts. During the time that tying is taking place, a hank removal claw 32 (FIGS. 6, 8 and 24*d*) on the tying machine 7 moves vertically downwardly to interpose itself between the coil and the face of the turntable at the tying station. Hence, when the tying machine 7 moves back to its retracted position (FIG. 24*g*) after the tie 9 is applied, the hank removal claw 32 pulls the hanked cord off of the posts 12 and drops the hank into a chute or the like (not shown) beneath the tying station. The hank removal claw 32 is actuated by a pneumatic cylinder actuator 232 that is carried by the tying machine 7, as best seen in FIG. 8.

Cord Feed Device

The cord presentation or feeding device 5 (FIGS. 1–4) has upper and lower arms 33 and 15, each of which comprises a pneumatic cylinder actuator.

The upper arm 33 is the cylinder of a rodless actuator of the type disclosed in U.S. Pat. No. 3,820,446, sold under the trademark Origa. That cylinder 33 is supported from above, in a fixed position, by means of a bracket 38 that projects up from the stationary frame or table 36 of the hanking machine. The axis of the cylinder 33 extends horizontally and obliquely to the axes of the turntables 10 and the turntable carrier 11. The cylinder 33 has a downwardly projecting slider 35 which moves along substantially its full length. On a laterally projecting bracket 235 the slider carries a cord-extending guide comprising a jaw mechanism 335 and a vertical actuator 445 for the jaw mechanism 335, said actuator being above that jaw mechanism and alongside the cylinder 33.

A front end of the upper arm 33 is over a trough 37 or the like to which cords are delivered by a cord processing machine (not shown) such as is disclosed in U.S. Pat. No. 3,909,900. The cords 8 that issue from such a machine are electrical conductors of uniform length, which have terminals attached to their ends or which are otherwise prepared for connection to appliances or the like.

The lower arm 15 of the feeding device 5 comprises a conventional pneumatic cylinder jack having a forwardly projecting rod 39 that carries a cord clamp 40 at its forward or outer end. The cylinder of the lower arm is mounted on a swivel bearing 41 near its rear end that defines a vertical axis which lies close to the upper arm 33 and about which the lower arm 15 is swingable through an acute angle. The lower arm 15 is actuated for such swinging by a double acting pneumatic actuator 42 that is connected between its cylinder and the fixed frame 36 of the machine.

In a starting position of the lower arm 15, its front end on which the cord clamp 40 is carried is substantially directly below the front end portion of the upper arm 33 and over the collecting trough 37. A cord delivered to that trough 37 is in such a position and orientation that a front end of it can be engaged by the cord clamp 40 on the lower arm 15, while an adjacent portion of the cord is slidably engaged by the jaw mechanism 335 of the upper arm, which is adjacent to the cord clamp 40 on the lower arm at the start of the feeding cycle. With the front end of the cord gripped by the clamp 40 on the lower arm, the jaw mechanism 335 closes to slidably embrace the cord and then moves back along the cylinder 33 with the slider 35 while maintaining its sliding engagement with the cord. The cord is thus drawn out to have a lengthening horizontal portion that extends between the clamp 40 and the moving slider mechanism 35, 335, while the remainder of the cord dangles from the jaw mechanism 335. As the slider 35 nears the rear end of its cylinder 33, it passes a rear cord clamp 44 on the lower arm 15, and immediately thereafter the actuator 42 swings the lower arm to its cord presenting position shown in FIG. 1. Such swinging of the lower arm brings its rear clamp 44 into engagement with the horizontally extending portion of the cord 8, and that clamp 44 grips the cord. The cord then has a straight horizontal portion extending between the two clamps 40, 44 on the lower arm; and that cord stretch is within the embrace of the two sets of gripper jaws 14 on the coiling posts 12 and also within the embrace of the jaws that will converge shortly afterward to define the guide eye 20 of the winding guide 19.

Figure 4:
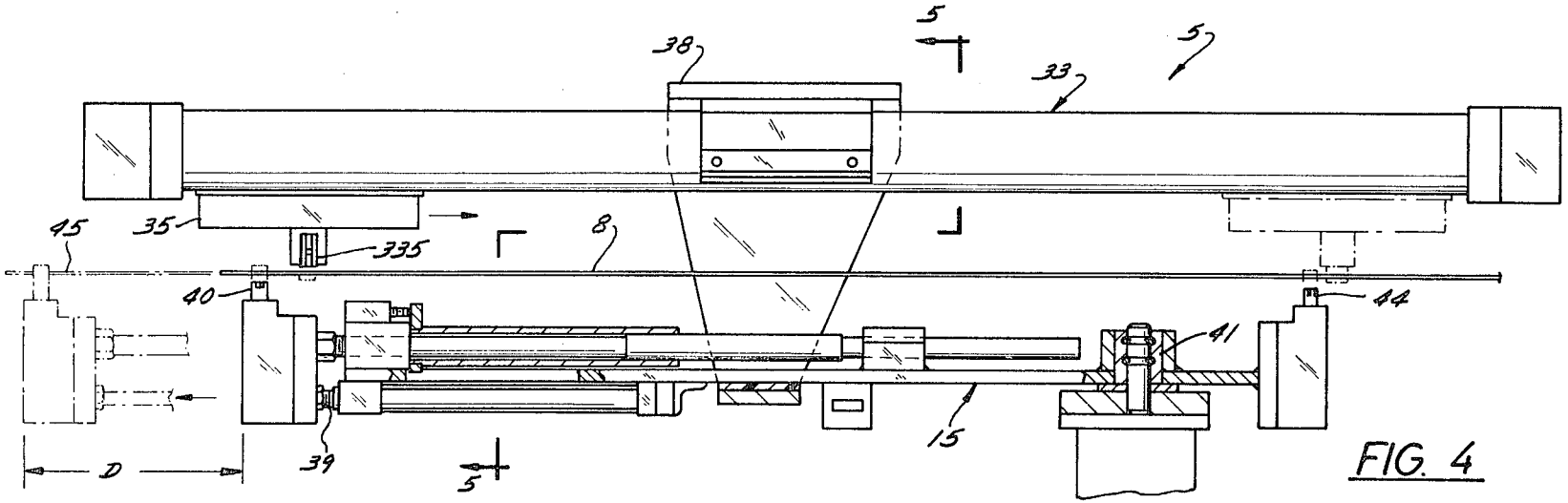
FIG. 4 is a view partly in elevation and partly in longitudinal section, showing the feed mechanism in its condition illustrated in FIG. 3.

Between the time that the front clamp 40 on the lower arm 15 grips the cord and the time that the cord is gripped by the coiling post grippers 14, the piston rod 39 of the lower arm 15 extends by a predetermined amount, designated by the distance D in FIG. 4. The distance D through which that rod 39 is extended, and by which its clamp 40 is established in spaced relation to its adjacent one of the coiling posts 12, determines the length of an unwound end portion or "pigtail" 45 of the hanked cord.

After the grippers 14 on the coiling posts and the jaws of the cord guide eye 20 have closed around the cord, the clamps 40 and 44 on the lower arm 15 release their grips on the cord and the lower arm is thereupon swung back to its initial position, underlying the upper arm 33 and well clear of the coiling station turntable and its posts 12, to be ready for the start of another cord presenting cycle.

Turntable Carrier and Rotation Drive for Turntables

Figure 9:
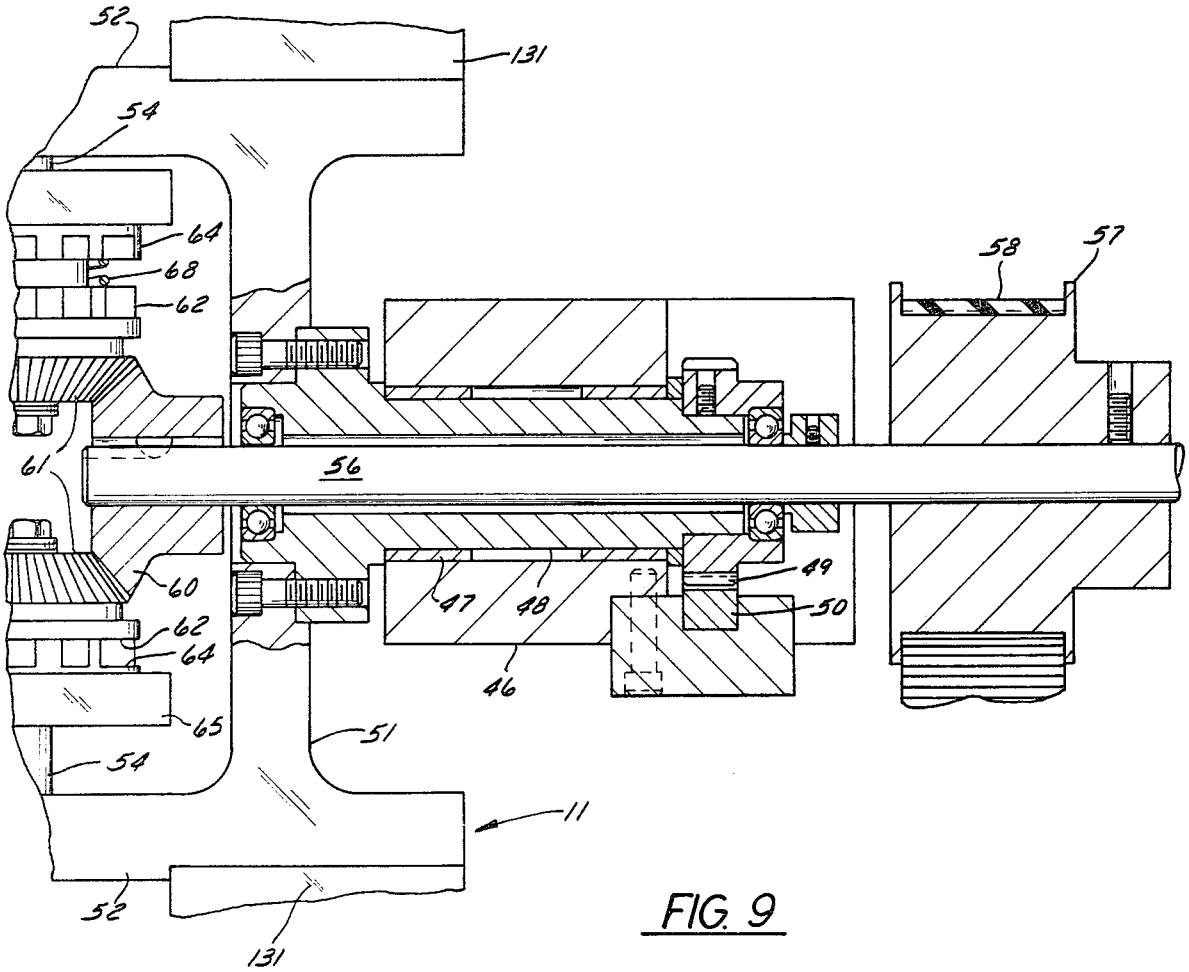
FIG. 9 is a view in longitudinal section through the shaft and transmission assembly that provides for pivoting support of the turntable carrier and for transmitting rotation to the turntables.
Figure 10:
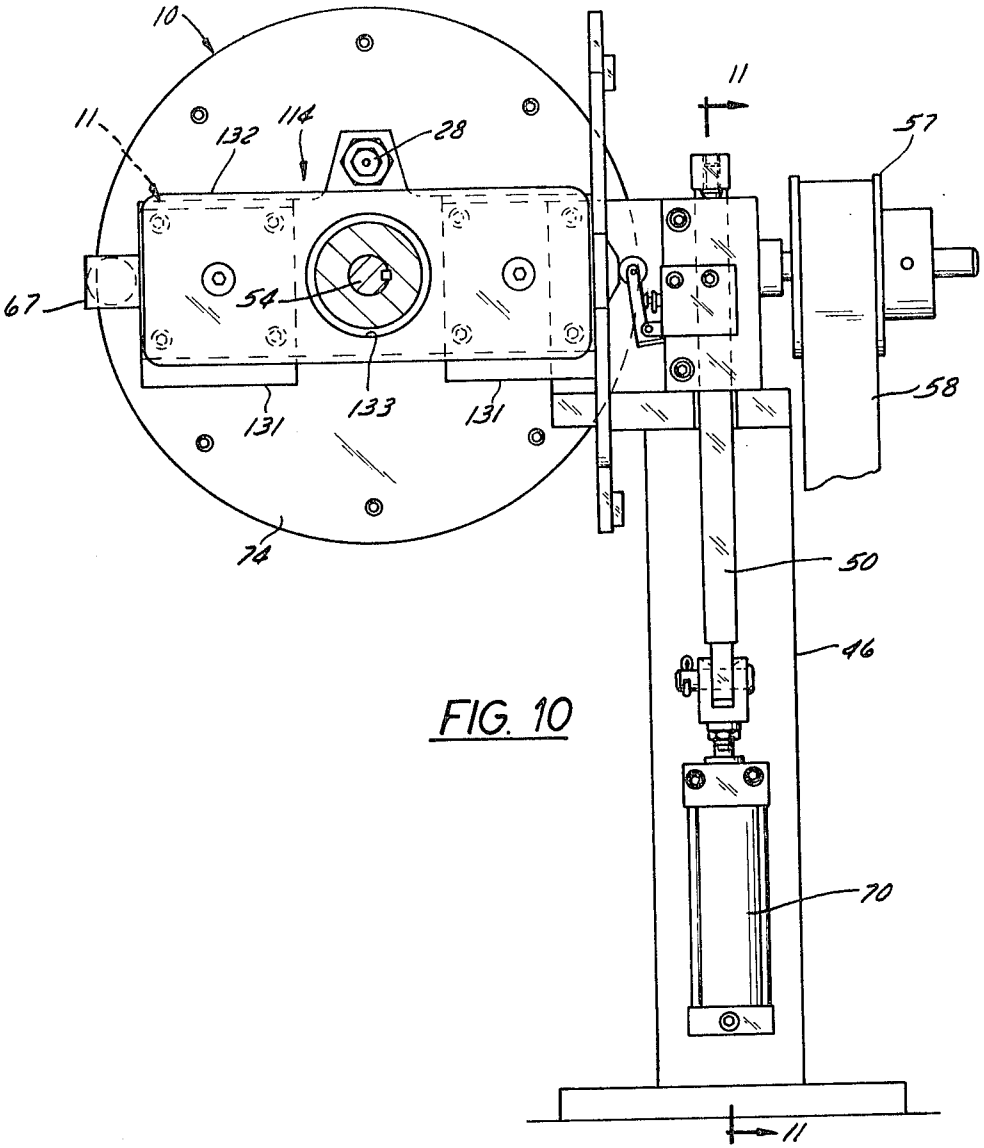
FIG. 10 is a view in section taken on the plane of the line 10—10 in FIG. 7.
Figure 11:
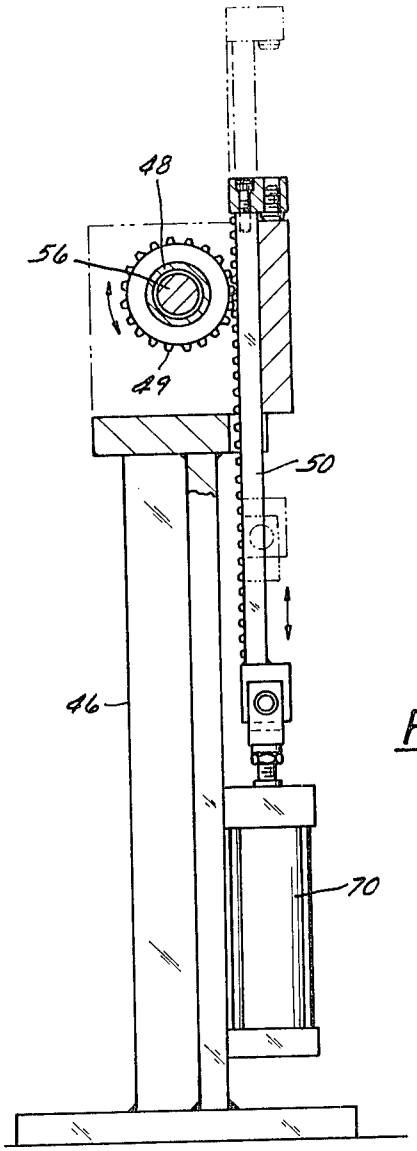
FIG. 11 is a view in section taken on the plane of the line 11—11 in FIG. 10.

The turntable carrier 11 is supported by a sturdy posts 46 (FIGS. 7 and 8) which projects up from the fixed frame 36 of the machine and which has near its top a bearing 47 (FIG. 9) through which there extends a tubular shaft 48 whereon the turntable carrier 11 pivots for its 180° rotational motions. Attached to the tubular shaft 48, at an outer side of the post 46, is a pinion 49 that cooperates with a rack 50 to impart the 180° swings to the turntable carrier 11, as explained hereinafter. At the other side of the post 46 is a U-shaped yoke 51 which constitutes the carrier proper. The bight portion of the yoke 51 is attached to the tubular shaft 48 and extends transversely to it, while each of the legs 52 of the yoke 51 supports a bearing 53 wherein a shaft 54 for one of the turntables 10 is journaled (FIG. 6).

For transmitting rotation from the stepping motor 17 to the turntables 10 there is a torque shaft 56 (FIG. 9) which rotatably extends through the tubular shaft 48 that supports the yoke 51. Fixed to the outer end of the torque shaft 56 is a driven pulley 57 which is connected by a belt 58 with a driver pulley 59 (FIGS. 7, 8) on the shaft of the stepping motor 17. The stepping motor 17 rotates in half-revolution increments, to provide for rotating each turntable at the coiling station through a predetermined number of half revolutions. To constrain the torque shaft 56 to unison rotation with the stepping motor 17, the belt 58 is of the toothed positive-drive type, and the driver pulley 59 and the driven pulley 57 around which that belt is trained are of like diameter and have teeth that mesh with those on the belt.

Fixed to the inner end of the torque shaft 56 is a driving bevel gear 60 which has constant meshing engagement with two driven bevel gears 61, one for each of the turntable shafts 54. Each driven bevel gear 61 is freely rotatable on the inner end of its turntable shaft 54 but is confined against axial motion relative to that shaft.

At any time that the stepping motor 17 is in operation, only the turntable 10 at the coiling station C rotates, while the other turntable is locked against rotation by its latching rod 28, as previously described. To transmit rotation from the driving bevel gear 60 to the shaft 54 of the turntable at the coiling station, the driven bevel gear 61 on each shaft 54 is coupled to it by a clutch. When the stepping motor 17 is not operating, the clutch is disengaged and both driven bevel gears 61 turn freely on their shafts 54, to prevent torque from being imposed upon the stepping motor 17 during swinging of the turntable carrier 11.

The clutch just mentioned (FIGS. 6 and 9) comprises a clutch facing 62 on each driven bevel gear 61, on the axial surface of the bevel gear that faces its turntable, preferably comprising axially projecting circumferentially spaced teeth. On each turntable shaft 54, between its bevel gear 61 and the adjacent leg 52 of the U-shaped yoke, there is a collar-like driven clutch element 64 which has a clutch facing that mates with the one on its adjacent bevel gear 61. Each clutch element 64 has a splined connection with its turntable shaft 54 that allows it to slide axially to and from clutching engagement with its bevel gear 61 but constrains its shaft 54 to rotate with it. A U-shaped clutch shifting yoke 65 has opposite legs which embrace the two driven clutch elements 64 to shift them simultaneously in one direction or the other along the turntable shafts 54. A mounting strut 66 that extends across the legs 52 of the turntable carrier yoke 51 supports a double-acting pneumatic clutch actuator 67 whereby the shifting yoke 65 is shifted to each of its defined positions. Each clutch element 64 is biased away from its adjacent bevel gear 61 and into engagement with its adjacent leg of the shifting yoke 65 by means of a coiled compression spring 68 that surrounds the turntable shaft 54 and reacts between the clutch element 64 and its bevel gear 61.

The 180° degree rotations of the turntable carrier 11 are imparted to it by means of a double-acting cylinder jack 70 (FIGS. 7, 8, 10, 11) that is mounted with its axis vertical on the post 46 that supports the turntable carrier 11. The rack 50 that meshes with the pinion 49 on the tubular shaft 48 of the turntable carrier comprises, in effect, a longitudinal extension of the piston rod of this actuator 70. Other suitable devices for producing 180° rotations in opposite directions are available and may be preferable in practice, although the rack and pinion mechanism 49, 50, 70 that is here illustrated has been found satisfactory in a prototype machine.

Turntables

Each turntable 10 comprises a front plate 73 and a back plate 74, both of which are disc-like and of like diameter, and which are secured in coaxial, spaced apart relationship by means of bolts that extend through spacer sleeves 75. The back plate 74 has a coaxial hub 83 on its rear by which it is anchored to the outer end of the shaft 54 for the turntable. Each of the coiling posts 12 of the turntable is mounted on a slider 76 that is between the two plates 73, 74 and is confined by L-section gibs or rails 77 to sliding motion in directions towards and from the turntable axis. To accommodate the motions of the posts 12 with their respective sliders 76, the front plate 73 has radially elongated slots 78 which extend in opposite radial directions from a large central hole 84 therein and through which the posts 12 respectively project.

Figure 13:
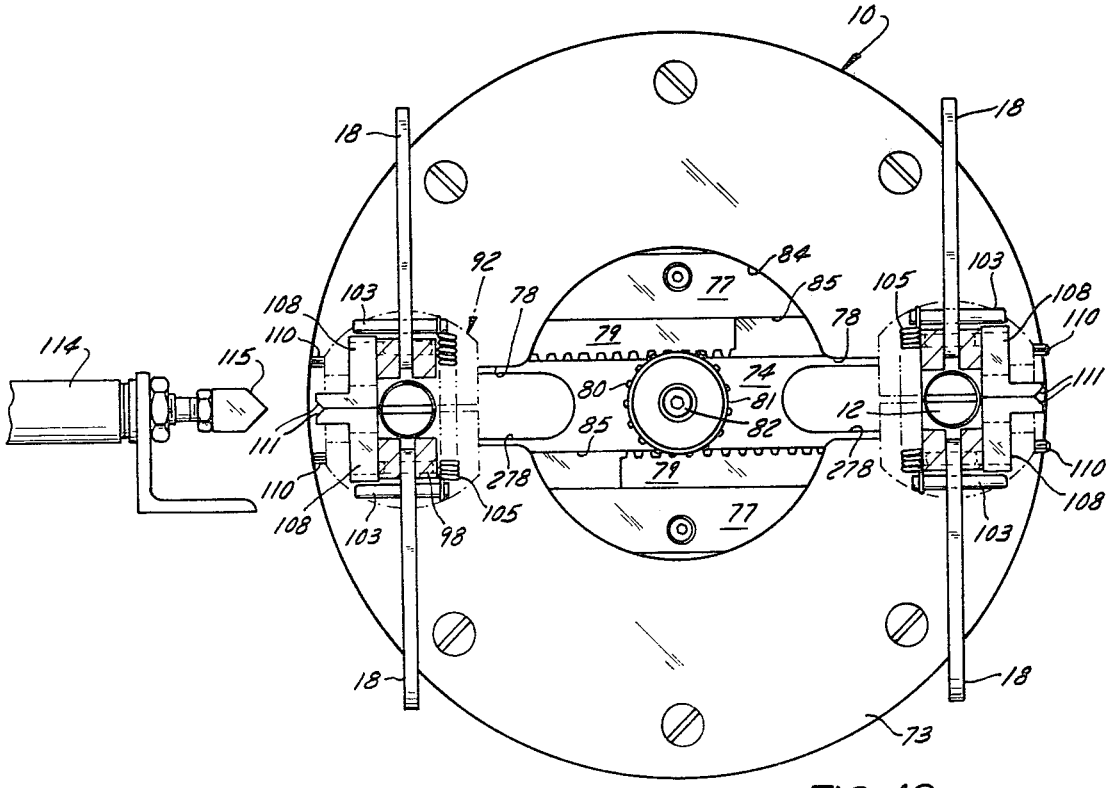
FIG. 13 is a view of one of the turntables, mainly in front elevation but with the claw mechanisms shown in section.
Figure 16:
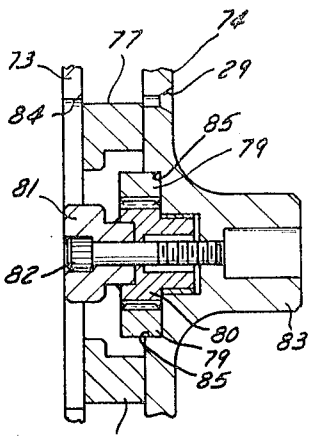
FIG. 16 is a fragmentary sectional view through a turntable, taken on the plane of the line 16—16 in FIG. 14.
Figure 14:
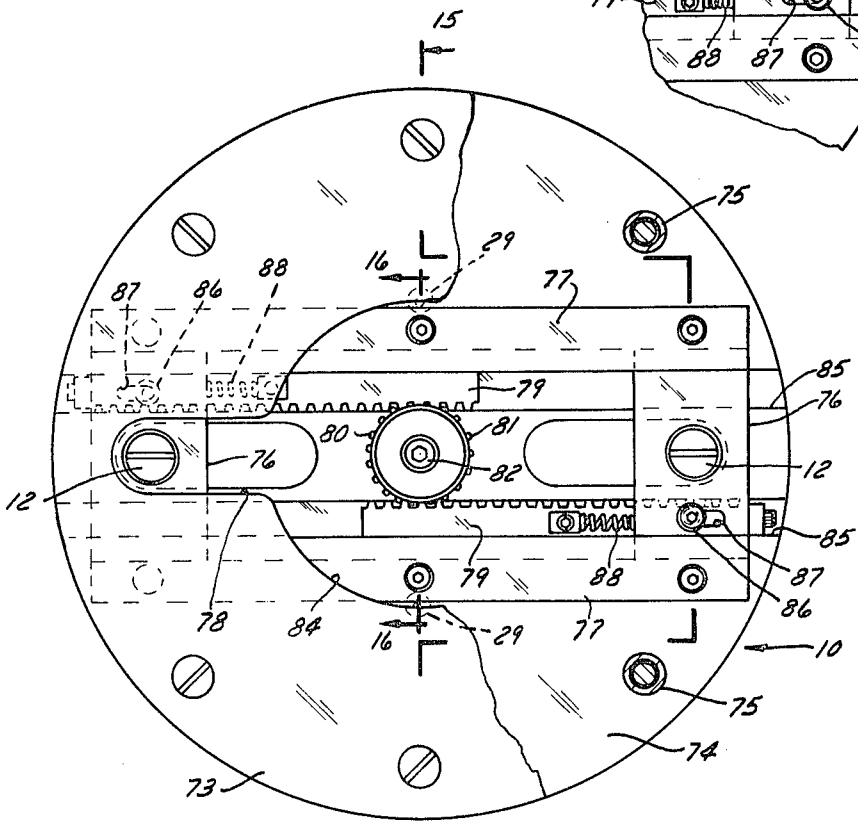
FIG. 14 is a view of a turntable, generally similar to FIG. 13, but with the coil holding claws removed and with a substantial portion of the front plate of the turntable shown broken away.
Figure 19:
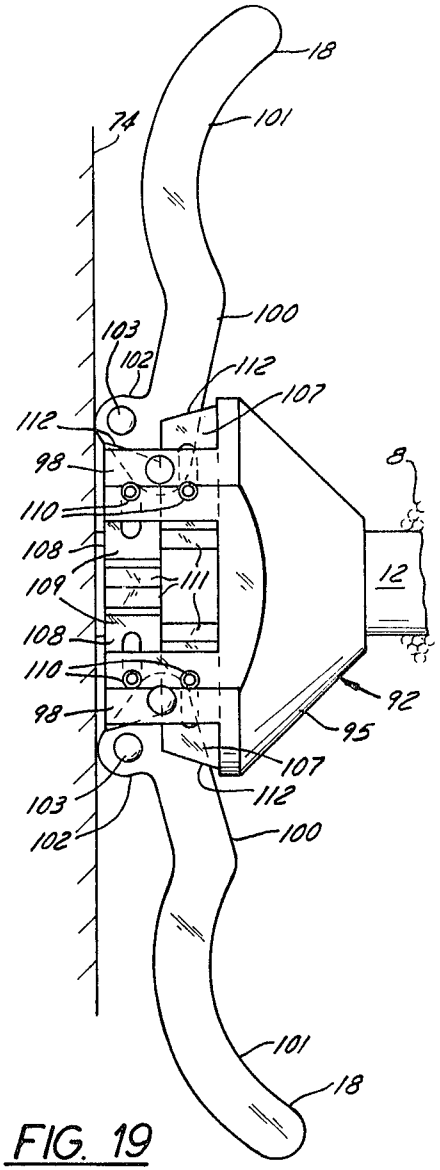
FIG. 19 is a view generally similar to FIG. 18 but showing the coil holding claws in their open or diverged condition.

Adjusted positions of the sliders 76, and hence of their coiling posts 12, are established by a pair of slide racks 79, one for each slider 76, both of which cooperate with an adjusting pinion 80 that is coaxially mounted in the turntable. The respective racks 79 meshingly engage the pinion 80 at diametrically opposite sides thereof (as best seen in FIGS. 13 and 14), and they extend in opposite radially outward directions substantially parallel to the slots 78 in the front plate. At its front side the pinion 80 is formed as a coaxial knob 81 (FIG. 16) which is accessible through the central hole 84 in the front plate 73 and by which the pinion 80 can be adjustingly rotated manually. However, the pinion 80 is normally confined against rotation by means of a clamping screw 82 that extends coaxially rearwardly through it and is threaded into the hub 83 on the back plate. When the clamping screw 82 is loosened, rotation of the pinion 80 by means of its knob 81 shifts the two racks 79 simultaneously, both racks moving either radially inwardly or radially outwardly, always through equal distances. Through a connection (described hereinafter) between each rack 79 and its post-carrying slider 76, such adjustment of the racks effects simultaneously positioning of the two posts 12.

The racks 79 are guided for their lengthwise motion in grooves 85 that extend across the front face of the back plate 74. Each rack 79 is further confined to lengthwise motion by its slider 76, which overlies the front face of the rack and which is itself confined to sliding motion by the L-section rails 77 that are secured to the front face of the back plate 74.

The connection between each post-carrying slider 76 and its rack 79 permits the slider to have limited motion relative to its rack in directions lengthwise of the rack. That connection comprises a screw 86 that is threaded into the rack and extends through a slot 87 in the slider that is elongated lengthwise of the rack. A coiled expansion spring 88 reacts between each slider 76 and its rack 79 to bias the slider in the direction away from the turntable axis, thus normally maintaining the slider 76 in its position in which the screw 86 is at the radially inner end of its slot 87.

Figure 17:
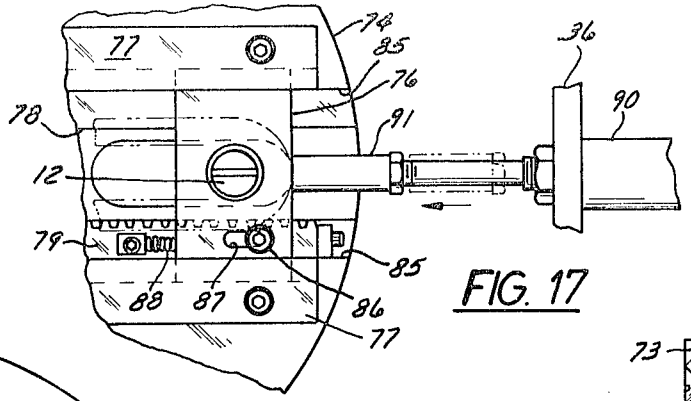
FIG. 17 is a detail view corresponding to a portion of FIG. 14 but showing the mechanism for converging the coiling posts for removal of a tied hank.

For converging the posts 12 of the turntable 10 at the tying station T, so that a hanked cord can be readily slid off of them by the hank detaching claw 32, there are (FIGS. 6 and 17) a pair of pneumatic actuators 90 on the fixed machine frame 36, one for each slider 76 of the turntable at the tying station, each comprising a pneumatic cylinder that has its axis aligned with its slider 76 and oriented horizontally, transversely to the turntable axes. The piston rods 91 of the actuators 90 extend simultaneously, engaging the respective sliders 76 to displace them towards the turntable axis, against the bias of the springs 88. The sliders 76 are released by the actuators 90 immediately after the hanked cord has been drawn off of the posts 12 by return of the tying machine to its retracted position.

Figure 15:
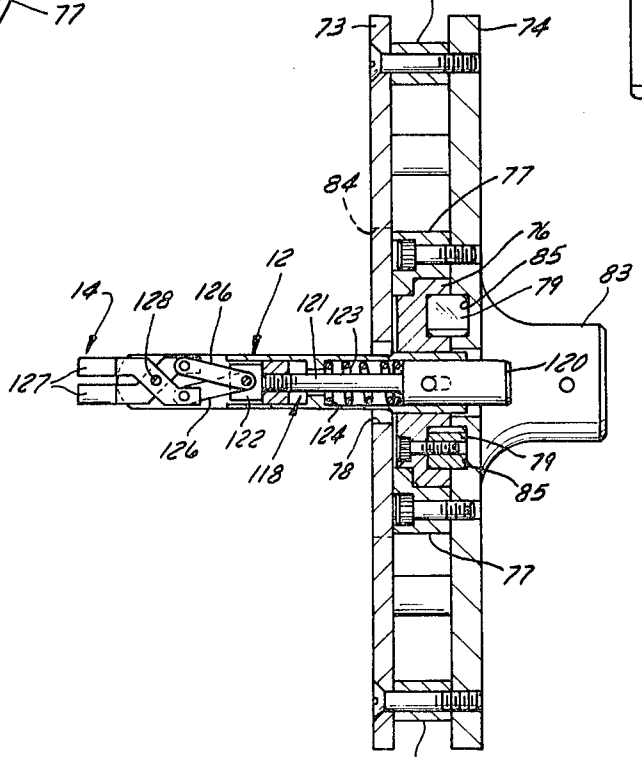
FIG. 15 is a view of a turntable mainly in section on the plane of the line 15—15 in FIG. 14.

Each of the coiling posts 12 is generally tubular (FIGS. 12 and 15) to accommodate a plunger 118 in its hollow interior through which the cord grippers 14 at its front end are actuated. The plunger 118 comprises an enlarged diameter rear portion 120, a concentric, forwardly projecting stem portion 121, and a forwardly bifurcated clevis 122 that is concentrically attached to the front end of the stem portion. A coiled compression spring 123 in the hollow post, surrounding the stem portion 121 of the plunger, biases the plunger rearwardly by reacting between its enlarged diameter rear portion 120 and a rearwardly facing circumferential shoulder 124 in the post, defined by a reduced diameter portion of its bore.

The cord gripping mechanism further comprises a pair of jaw members 127 and a pair of links 126 that are connected between the jaw members 127 and the clevis 122. The jaw members 127 comprise a pair of bent levers, each of which has a medial fulcrum connection with the post 12, provided by a pin 128 that extends through both jaw members 127 and has its ends fixed in diametrically opposite wall portions of the tubular post, near the front end thereof. The rear ends of the jaw members 127 have respective pin connections with the front ends of the two links 126, and both links, in turn have their rear ends swingably connected with the clevis 122.

It will be apparent that the front end portions of the jaw members 127, which comprise the grippers or jaws 14, swing convergingly and divergingly about the relatively fixed fulcrum pin 128, and that the jaw members 127 cooperate with the links 126 in the manner of a lazy tongs so that the rearward bias exerted upon the plunger 118 by the spring 123 tends to maintain the jaws 14 converged. Under the bias of the spring 123 the plunger 118 maintains a normal position in which its rear end portion projects behind the turntable to some extent so that the plunger can be driven forwardly, for opening of the jaws 14, by means of an actuator that engages both plungers. The back plate 74 of the turntable has radially elongated slots 278 through which the plungers 118 project. For the two plungers 118, the actuator comprises a pair of pneumatic cylinder jacks 131, mounted on the turntable carrier 11 behind the turntable, at opposite sides of the turntable axis. Since the positions of the posts 12 are shiftable radially relative to the turntable, whereas the actuator jacks 131 have to be mounted at fixed distances from the turntable axis, the piston rods of the two jacks 131 for each turntable are rigidly connected to a plate 132 which has its surfaces transverse to the plunger axes and which has a width nearly equal to the diameter of the turntable. The plate 132 can thus engage both plungers 118 anywhere in the range of excursions of the posts 12, although normally the plate 132 is spaced behind the plungers 118 so that the grippers 14 remain closed. To accommodate the hub 83 of the turntable, the plate 132 has a large central hole 133.

The pair of coil holding claws 18 for each coiling post 12 serves to prevent a wound coil from dropping off of the posts when the turntable carrier 11 makes its 180° swing. Such a set of claws is particularly needed for the turntable 10 that is carried through a downwardly facing position as it swings from the coiling station C to the tying station T, but for production uniformity and to simplify set-up of the machine for the hanking of various cords, a set of claws 18 can be associated with each coiling post, as shown in FIGS. 1, 6, 8 and 24.

Each set of claws 18 and the mechanism for actuating it is carried by a split collar 92 which is clampingly secured to its coiling post 12, adjacent to the front plate 73 of the turntable, by means of a clamping screw 93 which extends across the split 94 in the collar. The front portion 95 of the collar 92 comprises a forwardly tapering frustoconical guide surface whereby turns of cord being wound around the post 12 are guided forwardly to form a compact coil. The claws 18 are received and guided in deep slots 96 in the collar that open radially outwardly in opposite directions and extend all the way through it axially. At its rear the collar 92 has six rearwardly projecting post-like lugs 98 that are spaced from one another. There are two such lugs 98 at each side of each claw-guiding slot 96 in the collar, which lugs are bridged by a pivot pin 99; and on each such pivot pin one of the claws 18 is swingable.

Each claw 18 is a flat piece of metal having a straight rear end portion 100 which lies alongside its post 12 when the claw is in its operative position and a front end portion 101 which is curved to embrace a coil of cord and which is therefore concave at its side facing the post. The pivot pin 99 extends through the claw near its rear end, the axis of that pin being transverse to the flat surfaces of the claw. On the straight rear portion 100 of the claw, projecting laterally outwardly therefrom, is a lug 102 through which a toggle pin 103 extends with its axis parallel to that of the pivot pin 99. Considering the claw in its forwardly projecting operative position, the toggle pin 103 is spaced both forwardly and radially outwardly from the pivot pin 99; hence as the claw is swung between its open and its operative positions, the toggle pin 103 swings through an arc that carries it away from the adjacent post 12 and then back towards it again. Connected between the toggle pins 103 on the two claws 18 for each post 12, at one side of the post, is a tension spring 105 that serves to draw those claws to their operative and to their open positions with a toggling snap action.

Slidably confined between the flat front face of the turntable front plate 73 and the flat rear face of the collar 92 are two pairs of cam blocks, namely a front pair 107 which serves to actuate the claws 18 to their open or diverged positions and a rear pair 108 for actuating the claws to their operative positions. Each of the cam blocks 107, 108 is substantially L-shaped, with a base portion 109 which is guidingly confined between a pair of the rearwardly projecting post-like lugs 98 on the split collar and is further confined by a pin 110 which is received in those lugs and extends through an elongated slot in the base portion of the cam block. Projecting laterally from the base portion 109 of each cam block 107, 108 is a cam portion which has an oblique cam surface 111 at its extremity. These cam surfaces 111 on each pair of cam blocks 107, 108 are inwardly convergent so that the two cam blocks can be wedged apart by an actuator inserted between them. The base portion 109 of each cam block has at it outer end a toggling cam surface 112 that cooperates with an adjacent toggle pin 103 to swing the claw in one direction when the cam blocks 107 or 108 are wedged apart.

Figure 18:
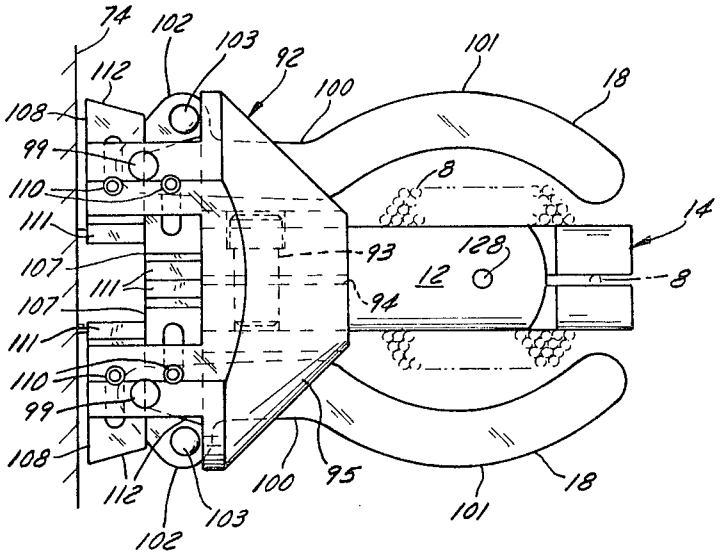
FIG. 18 is a fragmentary side view of one of the coiling posts, with its associated coil holding claws shown in their operative, converged condition.
Figure 20:
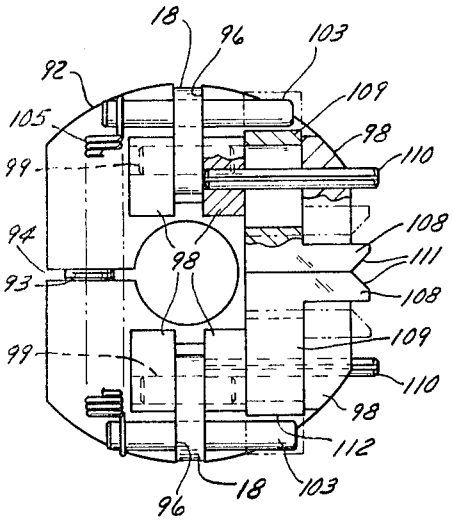
FIG. 20 is a view partially in elevation and partially in section, looking along the axis of a coiling post, showing the mechanism for actuating its associated coil holding claws to their diverged and converged conditions.
Figure 23:
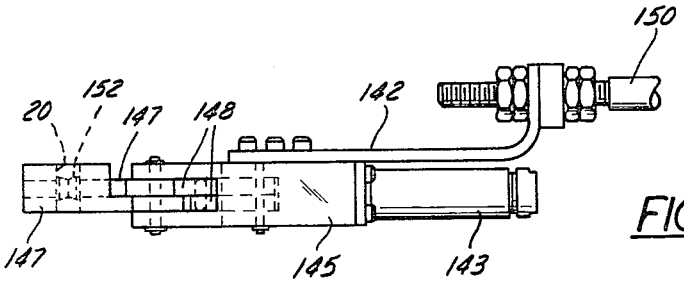
FIG. 23 is a top plan view of the left side of the cord guide mechanism shown in FIGS. 21 and 22.
Figure 21:
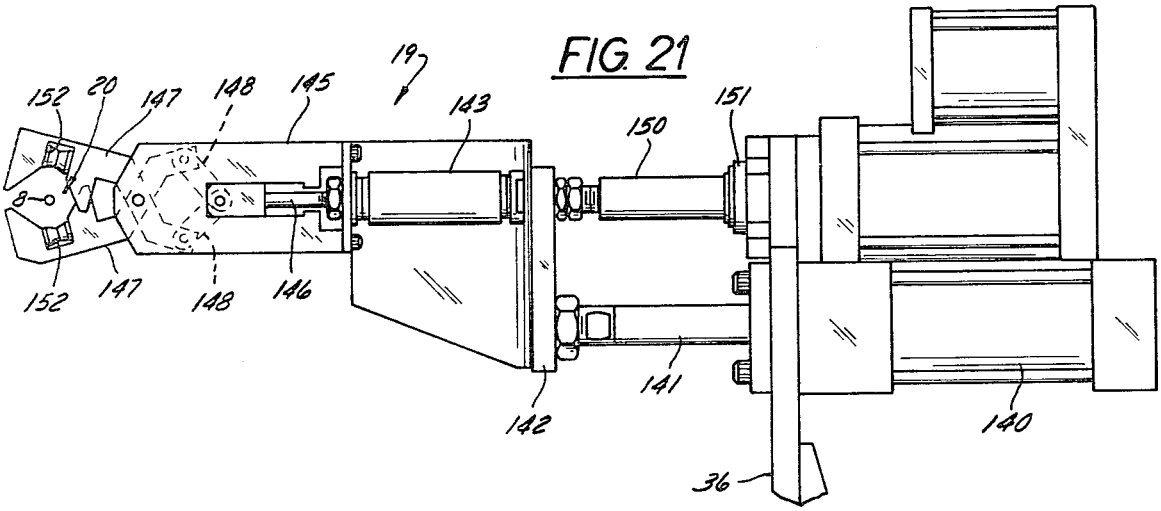
FIG. 21 is a view in side elevation of the cord guide, shown in the condition in which its jaws are open.
Figure 22:
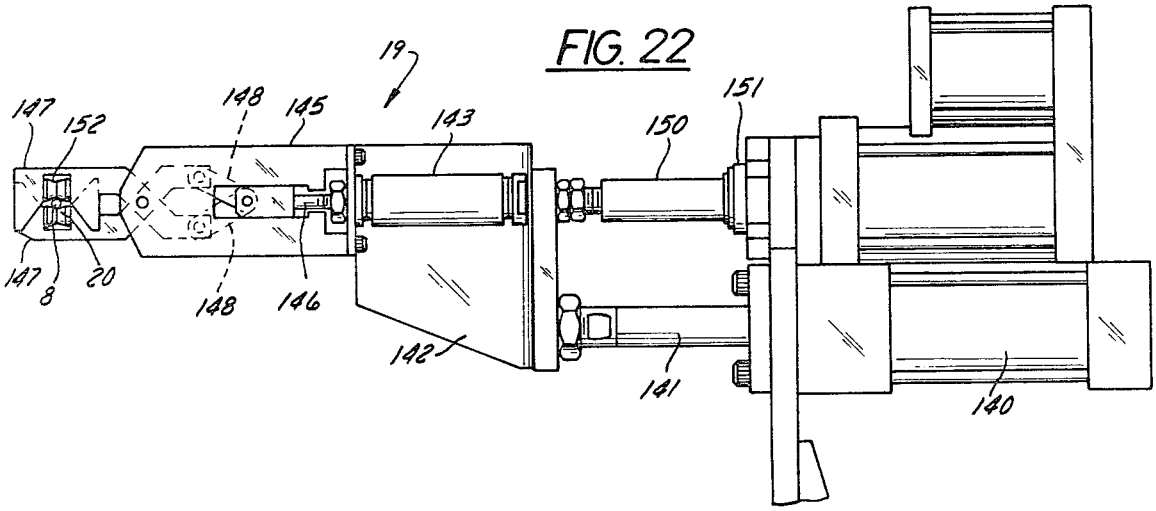
FIG. 22 is a view generally similar to FIG. 21 but showing the jaws converged to define a cord guiding eye.

The claws 18 are swung forward to their operative position (FIG. 17) from their open or diverged (FIG. 18) condition by means of an actuator 114 at the coiling station, which can comprise a pneumatic cylinder jack mounted on the fixed frame of the machine, alongside the turntable. The piston rod of that actuator 114, which moves in the direction towards the turntable axis, has its tip formed as a wedge 115 that comes between the cam surfaces 111 of the rear pair of cam blocks 108 and wedges them apart. Such divergence of the two rear cam blocks 108 is transferred to the toggle pins 103 on the respective claws through the toggling cam surfaces 112 on those blocks 108. At the tying station T there is an actuator 117 that is generally similar to the actuator 114 at the coiling station, but it is arranged to wedgingly diverge the front pair of cam blocks 107 and thus cause the toggle pins 103 to be swung rearwardly and apart, toggling the claws 18 to their open condition. The toggling cam surfaces 112 on the several cam blocks 107, 108 are so formed that the toggle pins 103 can impart convergent movement to a diverged set of cam blocks 107, 108; and thus movement of the claws 18 to their operative condition converges the front pair of cam blocks 107 and movement of the claws to their open condition converges the rear pair of cam blocks 108.

Winding Guide

The winding guide 19 comprises a double-acting cylinder jack 140 which is mounted on the fixed frame 36 of the machine with its piston rod 141 extending horizontally and parallel to the turntable axis. The piston rod 141, which is reciprocated in synchronism with turntable rotation, carries a bracket 142 that supports a jaw mechanism comprising the guide eye 20 and its actuator 143. The winding guide jaw mechanism is essentially a counterpart of the coil post gripper mechanism and thus comprises a tubular housing 145, a plunger 146 which is axially slidable in the housing 145, a pair of jaw members 147 which define the guide eye 20 when they are closed, and a pair of links 148 that are connected between the plunger 146 and the jaw members 147 in a lazy tongs arrangement. The actuator 143 for the winding guide jaw mechanism comprises a small pneumatic jack that is mounted on the bracket 142 behind the tubular housing 145. The piston rod of the actuator 143 is connected with the plunger 146 or can itself comprise that plunger.

To prevent the bracket 142 from rotating about the axis of the oscillating actuator 140, a guide rod 150 projects rearwardly from the bracket 142, in spaced parallel relation to the axis of the oscillating actuator 140, and it is slidably received in a bushing 151 fixed on the stationary part of the machine.

To enable the guided cord to pass smoothly through the eye 20 defined by the jaw members 147, each jaw member is provided with a cord engaging roller 152 or a similar means for minimizing friction between the eye 20 and the lengthwise moving cord being coiled.

It will be apparent that the cord clamps 40, 335 and 44 of the cord feeding device 5 can comprise mechanisms essentially like those for the grippers 14 and the cord guiding eye 20.

Timing

The several events in the sequence of operations performed by the machine can be timed in relation to one another in any suitable manner. Preferably, however, limit switches and timing cams are employed to a substantial extent, to ensure that one operation is successfully performed before the next operation is started. In most cases a limit switch will be actuated by an actuator when it attains one of its limits positions, but the turntable carrier can also have one or more cams whereby limit switches are actuated when that carrier reaches each of its defined positions. The locations, arrangement and manner of operation of all such switches will be evident from the preceding description, and therefore, to simplify the drawings, they have not been shown.

It is preferred that limit switches be connected as position sensors that provide inputs to a computer which maintains overall control of the operating program in a known manner.

From the foregoing description taken with the accompanying drawings it will be apparent that this invention provides an automatic cord hanking machine which can receive cords one-by-one as they issue from a processing machine, coil each cord, tie it with a wire tie, and eject the hanked cord to a delivery chute or the like, all without the intervention of a human operator. It will also be apparent that the cord hanking machine of this invention is capable of a high rate of production, being so arranged as to tie a coiled cord simultaneously with the coiling of the next cord fed to the machine, and being further so arranged that in the course of the several operations that the hanking machine performs upon a cord, the cord always moves in one direction, from the processing machine to the delivery chute, and there is no interference between the mechanisms that perform the various operations upon the cord.

What is claimed is:

1. A cord hanking machine whereby each of a succession of cords of substantially uniform length is wound into a coil and a wire tie is applied around each coil, said machine being characterized by:

A. a pair of turntables, each having a pair of forwardly projecting coiling posts that are spaced equal distances to opposite sides of a rotational axis of the turntable;

B. a turntable carrier on which said turntables are mounted in coaxial spaced apart relationship, with the coiling posts on each turntable projecting away from the other turntable;

C. means mounting said turntable carrier for rotation in fixed increments about a carrier axis transverse to the coinciding axes of the turntables, to carry each turntable alternately (1) to a coiling station at which a length of cord is delivered to the turntable and the turntable is rotated to coil and said cord around its coiling posts and (2) to a tying station at which a tie is applied around a coiled cord on the turntable;

D. a tying machine for applying a tie around a coiled cord; and

E. means for moving said tying machine in opposite directions parallel to said coinciding axes, between an operative position adjacent to the turntable at the tying station and a retracted position spaced at a substantial distance from that turntable.

2. The cord hanking machine of claim 1, further characterized by:

F. a hank detaching claw carried by said tying machine for bodily movement therewith and for motion relative thereto in opposite directions transverse to said coinciding axes; and G. claw actuator means reacting between said tying machine and the hank detaching claw to move the latter in said opposite directions and whereby, when the tying machine is in its operative position, said claw is engaged behind a cord coiled around the coiling posts of the turntable at the tying station, for drawing the cord forwardly off of those coiling posts upon return of the tying machine to its retracted position.

3. The cord hanking machine of claim 1, further characterized by:

F. a pair of sliders carried by each of said turntables, each of said sliders being confined to radially inward and outward motion relative to its turntable and having one of the coiling posts for the turntable secured thereto and projecting forwardly therefrom;

G. abutment means on each turntable, engageable by each of the sliders on the turntable to define a limit of its radially outward motion;

H. yielding biasing means urging each of said sliders to the limit of its radially outward motion; and I. a pair of slider actuators on a fixed part of the machine, adjacent to the tying station, each arranged to impart radially inward motion to one of the sliders for converging the coiling posts to facilitate forward removal of a coiled cord therefrom.

4. The cord hanking machine of claim 3, further characterized by:

said abutment means on each turntable comprising (2) a manually rotatable pinion coaxially mounted on the turntable;

(2) a pair of elongated racks that are confined to lengthwise motion in the directions of motion of the sliders and each of which has an abutment engageable by one of the sliders, said racks having meshing engagement with the pinion at diametrically opposite sides thereof so that adjusting rotation of the pinion displaces the racks through equal distances in opposite directions; and (3) releasable means on each turntable for confining its pinion against rotation.

5. The cord hanking machine of claim 1 wherein each of said coiling posts is substantially tubular, further characterized by:

F. a pair of cord gripper jaws on the front end of each coiling post, arranged to open and close in directions substantially normal to a plane containing the axes of the two coiling posts on the turntable;

G. means normally biasing each pair of gripper jaws to its closed position; and

H. actuation means for opening the pair of gripper jaws on each coiling post against bias, said actuation means comprising (1) a plunger axially slidable in the coiling post and having a rear end portion which normally projects behind the turntable, and (2) an actuator mounted on the turntable carrier behind each turntable having a movable element which engages the rear end portion of each plunger on the turntable and drives the same forwardly.

6. The cord hanking machine of claim 1, further characterized by:

F. means for swinging said turntable carrier about said carrier axis through 180° alternately in opposite directions.

7. A cord hanking machine whereby each of a succession of cords of substantially uniform length is wound into a coil around which a tie can be applied to form the cord into a hank, said machine being characterized by:

A. a pair of turntables, each having a pair of forwardly projecting coiling posts which are spaced equal distances to opposite sides of a rotational axis of the turntable;

B. a turntable carrier on which said turntables are rotatably mounted in coaxial spaced apart relationship, with the coiling posts on each turntable projecting away from the other turntable;

C. mounting means supporting said turntable carrier for rotational movements about a carrier axis transverse to the coinciding axes of the turntables; to carry each turntable alternately (1) to a coiling station at which a length of cord is delivered to the turntable and the turntable is rotated to coil the cord around its coiling posts and (2) to another station at which a further operation is performed upon the coiled cord, said mounting means comprising a substantially tubular shaft concentric to said carrier axis;

D. a torque shaft coaxially rotatable in said tubular shaft, said torque shaft having at one end thereof a driving connection with a motor for rotating the turntables;

E. clutch means on said turntable carrier having a pair of alternative conditions;

(1) in one of which said torque shaft is drivingly connected with the turntable at the coiling station and (2) in the other of which said torque shaft is disconnected from both turntables; and F. a pair of latching devices on said turntable carrier, one for each turntable, each of said latching devices being arranged to engage its turntable and prevent rotation thereof at all times other than when the turntable is at the coiling station and said clutch means is in said other one of its alternative conditions.

8. A cord hanking machine of the type comprising a turntable rotatable about an axis and having a pair of forwardly projecting coiling posts which are spaced equal distances to opposite sides of said axis and around which a cord to be hanked can be coiled by rotation of the turntable, said machine being characterized by:

A. a pair of cord gripper jaws on the front end portion of each of said posts, the jaws for each post being movable between open and closed positions in directions transverse to the post and being biased towards their closed positions;

B. thrust transmitting means on the turntable, spaced behind the gripper jaws and movable relative to the turntable, said thrust transmitting means being drivingly connected with the gripper jaws to be maintained in a normal position by the biasing force on the gripper jaws; and C. actuator means adjacent to the turntable, engageable with the thrust transmitting means to shift the same out of said normal position and thereby move the gripper jaws to their open positions.

9. The cord hanking machine of claim 8, further characterized by:

D. means defining a coiling station at which said turntable has a predetermined position during at least a part of the time that the machine is in operation;

E. releasable turntable latching means engageable with the turntable to maintain it in a predetermined rotational orientation at times when it is not rotating; and F. a cord guide at said coiling station, spaced to one side of said turntable position, comprising (1) a guide eye through which a cord to be hanked is lengthwise slidable and which is defined by forwardly opening jaw members, and (2) means operable during rotation of the turntable for oscillating said guide eye rearwardly away from and forwardly back to a cord receiving position in which said guide eye is aligned with the cord gripper jaws on both posts when the turntable is in said position and rotational orientation.

10. The cord hanking machine of claim 9, further characterized by:

(1) said means for oscillating said guide eye comprising a double-acting cylinder jack having an axially reciprocable piston rod;

(2) said jaw members that define the guide eye being carried by said piston rod; and (3) said piston rod further carrying a second double acting cylinder jack whereby said jaw members that define the guide eye are opened for reception of a cord and closed to define said guide eye.

11. The hanking machine of claim 8, further characterized by:

D. means defining a coiling station at which said turntable has a predetermined position during at least a part of the time that the machine is in operation;

E. releasable turntable latching means engageable with the turntable to maintain it in a predetermined rotational orientation at times when it is not rotating; and F. cord feeding means operable when the turntable is in said position and rotational orientation to insert a cord between the gripper jaws of both posts, said cord feeding means comprising (1) an arm extending in a direction substantially transverse to the turntable axis and parallel to a plane containing the axes of the posts, said arm being swingable parallel to said plane between a cord receiving position spaced forwardly from said gripper jaws and a cord delivering position adjacent to said gripper jaws, (2) a cord clamp near each end of said arm, and (3) a slider movable from one of said cord clamps to the other when said arm is in its cord receiving position, said slider being slidably engageable with a cord held by said one cord clamp to guidingly extend the cord to said other cord clamp and bring it into engagement therewith.

12. A cord hanking machine of the type comprising a turntable rotatable about an axis and having a pair of forwardly projecting coiling posts which are spaced equal distances to opposite sides of said axis and around which a cord is coiled by rotation of the turntable, and a tying machine by which a wire tie is looped around a coiled cord and twisted upon itself, said cord hanking machine being characterized by:

A. means defining a tying station at which, during at least a part of the time that the hanking machine is in operation, the turntable has a predetermined position with its axis horizontal;

B. releasable turntable latching means engaged with the turntable when it is at said tying station to maintain the turntable in a predetermined rotational orientation;

C. means mounting said tying machine for bodily movement in opposite directions substantially parallel to the axis of the turntable at the tying station; and D. tying machine actuator means for moving the tying machine in said opposite directions between an advanced position in which the tying machine is adjacent to the turntable for tying a cord coiled around the coiling posts and a retracted position in which the tying machine is spaced a substantial distance forwardly from the coiling posts.

13. The cord hanking machine of claim 12, further characterized by:

E. said turntable being mounted on a turntable carrier whereby it is bodily moved between said tying station and a coiling station at which the turntable is rotated to coil a cord around its posts.

14. The cord hanking machine of claim 13, further characterized by:

F. a second turntable, similar to the first mentioned turntable, said second turntable being mounted on said turntable carrier in coaxial rearwardly spaced relation to said first mentioned turntable and with its coiling posts projecting away from the same; and G. said turntable carrier being rotatable in 180° increments about a carrier axis transverse to the coinciding axes of said turntables to carry each turntable alternately to said tying station and to said coiling station.

15. The cord hanking machine of claim 12, further characterized by:

E. a pair of sliders on the turntable, each of which carries one of said coiling posts, each slider being movable relative to the turntable in opposite substantially radial directions;

F. abutment means on the turntable defining a pair of abutments, one for each slider, each engageable by its slider to define a limit of radially outward motion thereof relative to the turntable;

G. means yieldingly biasing each slider towards engagement with its abutment; and H. post convergence actuator means at said tying station, engageable with said sliders to move the same against their bias and thus converge the posts.

16. The cord hanking machine of claim 15, further characterized by:

J. a pinion coaxially mounted on the turntable and accessible for adjusting rotation;

K. said abutment means comprising a pair of elongated toothed racks having meshing engagement with said pinion at opposite sides thereof, each of said racks extending lengthwise in one of said opposite substantially radial directions and being confined to lengthwise sliding motion relative to the turntable, so that the positions of said abutments can be simultaneously shifted through equal distances in opposite radial directions by rotation of said pinion; and L. releasable locking means on the turntable for confining said abutment means against shifting relative to the turntable.

17. The cord hanking machine of claim 12, further characterized by:

E. a hank detaching claw mounted on said tying machine for movement relative thereto in opposite directions transverse to the turntable axis whereby said hank detaching claw is carried between operative and inoperative positions; and F. claw actuator means on said tying machine, operable when the tying machine is in its advanced position to move the hank detaching claw to its operative position, engaged behind a cord coiled around said posts, and operable when the tying machine is in its retracted position to move the hank detaching claw to its inoperative position.

18. A cord hanking machine of the type comprising a turntable having a rotational axis and having a pair of forwardly projecting coiling posts spaced to opposite sides of said axis, and a tying machine for placing a tie around a cord that has been coiled on said turntable, said cord hanking machine being characterized by:

A. a turntable carrier on which said turntable is rotatably mounted;

B. means mounting said turntable carrier for rotary motion about a carrier axis transverse to said rotational axis to carry said turntable between a coiling station at which the turntable is rotated and a typing station at which said rotational axis is substantially horizontal;

C. means mounting said tying machine for motion towards and from a turntable at the tying station in directions parallel to its rotational axis; and D. means for alternately moving the tying machine (1) in one of said directions to a position adjacent the turntable at the tying station, where the tying machine can place a tie around a coil of cord on the tying posts and (2) in the opposite direction to a position spaced substantially forwardly of the turntable to the clear of the turntable as it is carried into and out of the tying station.

19. The cord hanking machine of claim 18, further comprising a motor by which the turntable is rotated at the coiling station, further characterized by:

E. a clutch by which the motor is drivingly connectable with the turntable and disconnectable therefrom; and F. turntable latching means on the turntable carrier, releasably engageable with the turntable to confine the same in a predetermined rotational orientation.

20. A hanking machine comprising a turntable rotatable about an axis and having a pair of forwardly projecting posts which are spaced to opposite sides of said axis and about which a cord is coiled by rotation of the turntable, said hanking machine being characterized by:

A. a pair of forwardly projecting cord gripper jaws mounted on the front end portion of each of said posts for convergent and divergent swinging motion about a pivot axis which coincides with the pivot axis of the gripper jaws on the other post;

B. a plunger for each post, each post being substantially tubular and having its plunger slidable forwardly and rearwardly therein;

c. means providing a connection between the respective plunger and gripper jaws for each post whereby the jaws are closed by motion of the plunger to a rearward position in which a portion of the plunger projects behind the turntable and are opened by forward motion of the plunger out of that position;

D. means biasing each plunger to its said rearward position; and

E. an actuator on the machine, behind the turntable, having a plunger driving element movable forwardly to engage the rear ends of the plungers and drive them out of their rearward positions.

21. A hanking machine comprising a turntable rotatable about an axis and having a pair of forwardly projecting posts which are spaced to opposite sides of said axis and about which a cord is coiled by rotation of the turntable, said hanking machine being characterized by:

A. a turntable carrier upon which the turntable is rotatable and which is mounted for rotary motion about a carrier axis transverse to the axis of the turntable, to swing the turntable between a coiling station at which the turntable is rotated and another station at which a coiled cord is removed from the turntable;

B. a pair of coil holding claws mounted adjacent to at least one of said posts, at opposite sides thereof, for swinging motion between forwardly projecting converged positions and laterally projecting diverged positions, each of said claws being curved along its length to embrace a coiled cord and confine it against sliding forwardly along said one post when the claws are in their converged positions;

C. toggle means comprising (1) spring means connected with the claws to yieldingly maintain them in each of said positions, (2) first cam means slidable transversely to said one post for actuating the claws to their converged positions, and (3) second cam means slidable transversely to said one post for actuating the claws to their diverged positions;

D. an actuator at the coiling station cooperable with the first cam means to shift the claws to their converged positions upon conclusion of turntable rotation; and E. a second actuator at said other station, cooperable with said second cam means to shift the claws to their diverged positions.

* * * * *